US011438999B2

(12) United States Patent
Leemans et al.

(10) Patent No.: US 11,438,999 B2
(45) Date of Patent: Sep. 6, 2022

(54) DEVICES AND METHODS FOR CREATING PLASMA CHANNELS FOR LASER PLASMA ACCELERATION

(71) Applicants: Wim Leemans, Hamburg (DE); Kelly Swanson, San Francisco, CA (US); Hann-Shin Mao, Richmond, CA (US); Don Syversrud, Cape Coral, FL (US); Anthony Gonsalves, Berkeley, CA (US); Tyler Sipla, Oakland, CA (US)

(72) Inventors: Wim Leemans, Hamburg (DE); Kelly Swanson, San Francisco, CA (US); Hann-Shin Mao, Richmond, CA (US); Don Syversrud, Cape Coral, FL (US); Anthony Gonsalves, Berkeley, CA (US); Tyler Sipla, Oakland, CA (US)

(73) Assignee: The Regents of the University of California, Oakland, CA (US)

( * ) Notice: Subject to any disclaimer, the term of this patent is extended or adjusted under 35 U.S.C. 154(b) by 39 days.

(21) Appl. No.: 17/093,240

(22) Filed: Nov. 9, 2020

(65) Prior Publication Data

US 2021/0212190 A1 Jul. 8, 2021

Related U.S. Application Data

(60) Provisional application No. 62/935,777, filed on Nov. 15, 2019.

(51) Int. Cl.

| | |
|---|---|
| ***H05H 1/54*** | (2006.01) |
| ***H05H 15/00*** | (2006.01) |
| ***H05H 1/02*** | (2006.01) |

(52) U.S. Cl.
CPC ..... *H05H 1/54* (2013.01); *H05H 1/02* (2013.01); *H05H 15/00* (2013.01)

(58) Field of Classification Search
None
See application file for complete search history.

(56) References Cited

U.S. PATENT DOCUMENTS 5,637,966 A * 6/1997 Umstadter ..... G21K 1/003 315/505
5,789,876 A * 8/1998 Umstadter ..... H01J 23/06 315/501
6,815,700 B2 * 11/2004 Melnychuk ..... H05G 2/003 250/493.1

(Continued)

OTHER PUBLICATIONS

Shvets et al., "Excitation of Accelerating Wakefields in Inhomogeneous Plasmas," IEEE Transactions on Plasma Science, vol. 24, No. 2, pp. 351-362, (Apr. 1996).

(Continued)

*Primary Examiner* — Srinivas Sathiraju

(57) ABSTRACT

This disclosure provides systems, methods, and apparatus related to devices and methods for creating hollow, near-hollow, and parabolic plasma channels. In one aspect, a device includes a block of material and a cooling system. The block of material defines a channel having a cylindrical shape and having a first open end and a second open end. An axis of the channel lies along a straight line. The block of material further defines a first gas port and a second gas port. The first gas port and the second gas port are in fluid communication with channel. The cooling system is operable to cool the channel to below the freezing point of a gas.

20 Claims, 26 Drawing Sheets

(56) References Cited

U.S. PATENT DOCUMENTS

| | | | | |
|---|---|---|---|---|
| 8,075,732 | B2 * | 12/2011 | Partlo | B08B 7/00 156/345.35 |
| 8,299,713 | B2 * | 10/2012 | Hooker | H05G 2/00 315/505 |
| 8,396,190 | B2 * | 3/2013 | Ahn | H05G 2/008 378/119 |
| 8,878,464 | B2 * | 11/2014 | Clayton | A61N 5/1001 315/501 |
| 9,497,843 | B1 * | 11/2016 | Kaganovich | H05H 1/24 |
| 10,433,412 | B2 * | 10/2019 | Mao | A61N 5/1007 |
| 10,847,340 | B2 * | 11/2020 | Papeer | G21K 1/093 |
| 10,959,318 | B2 * | 3/2021 | Khodykin | G01N 23/201 |
| 11,013,100 | B2 * | 5/2021 | Hidding | H05H 1/46 |
| 2004/0108473 | A1 * | 6/2004 | Melnychuk | H05G 2/008 250/504 R |
| 2005/0269529 | A1 * | 12/2005 | Ershov | G21K 1/06 250/504 R |
| 2008/0258085 | A1 * | 10/2008 | Bauer | H05G 2/001 250/504 R |
| 2011/0199000 | A1 * | 8/2011 | Hooker | H05G 2/00 315/111.61 |
| 2012/0080618 | A1 * | 4/2012 | Clayton | A61N 5/1001 250/492.3 |
| 2018/0168024 | A1 * | 6/2018 | Mao | H05H 1/54 |

OTHER PUBLICATIONS

Schroeder et al., "Multimode analysis of the hollow plasma channel accelerator," AIP Conference Proceedings, vol. 472, No. 1, pp. 453-460 (1999).
Schroeder et al., "Control of focusing forces and emittances in plasma-based accelerators using near-hollow plasma channels," Physics of Plasmas, vol. 20, No. 8, pp. 080701-1-080701-4, (Aug. 5, 2013).
Chiou et al., "Laser wakefield acceleration & optical guiding in a hollow plasma channel," AIP Conference Proceedings, vol. 279, No. 1, pp. 480-489, (1992).
Schroeder et al.,"Multimode Analysis of the Hollow Plasma Channel Wakefield Accelerator," Physical Review Letters, vol. 82, No. 6, pp. 1177-1180, (Feb. 8, 1999).
Jain et al., "Positron acceleration by plasma wakefields driven by a hollow electron beam," Physical Review Letters, vol. 115, No. , pp. 195001-1-195001-6, (Nov. 19, 2015).
Marsh et al., "Positron Beam Propagation in a Meter Long Plasma Channel," Proceedings of the 2003 Particle Accelerator Conference, pp. 731-733. (2003).
Gessner et al., "Demonstration of a positron beam-driven hollow channel plasma wakefield accelerator," Nature Communications, vol. 7, pp. 1-6, (Jun. 2, 2016).
Fan et al., "Tubular plasma generation with a high-power hollow Bessel beam," Physical Review E, covering statistical, nonlinear, biological, and soft matter physics, vol. 62, No. 6, pp. R7603-R7606, (Dec. 1, 2000).
Gonsalves et al., "Demonstration of a high repetition rate capillary waveguide," Journal of Applied Physics, vol. 119, No. 3, pp. 033302-1-033302-11, (Jan. 1, 2016).
Leemans et al., "Laser-driven plasma-wave electron accelerators," Physics Today, vol. 62, No. 3, pp. 44-49, (Mar. 2009).
Kim et al., "Characteristics of a tapered capillary plasma waveguide for laser wakefield acceleration," Applied Physics Letters, vol. 102, pp. 204103-1-204103-4, (May 23, 2013).
Katsouleas, "Electrons hang ten on laser wake," Nature, vol. 431, pp. 515-516, (Sep. 30, 2004).
Esarey et al., "Overview of Plasma-Based Accelerator Concepts," IEEE Transactions on Plasma Science, vol. 24, No. 2, pp. 252-288, (Apr. 1996).
Geddes et al., "High-quality electron beams from a laser wakefield accelerator using plasma-channel guiding," Nature, vol. 431, pp. 538-541, (Sep. 30, 2004).
Mangles et al., "Monoenergetic beams of relativistic electrons from intense laser-plasma interactions," Nature, vol. 431, pp. 535-538, (Sep. 30, 2004).
Faure et al., "A laser-plasma accelerator producing monoenergetic electron beams," Nature, vol. 431, pp. 541-544, (Sep. 30, 2004).
Malka et al., "Principles and applications of compact laser-plasma accelerators," Nature Physics, vol. 4, pp. 447-453, (Jun. 2008).
Burza et al., "Laser wakefield acceleration using wire produced double density ramps," Physical Review Special Topics—Accelerators and Beams, vol. 16, pp. 011301-1-011301-5, (2013).
Esarey et al., "Physics of laser-driven plasma-based electron accelerators," Reviews of Modern Physics, vol. 81, pp. 1229-1285, (Aug. 27, 2009).
Suk et al., "A Gas-Filled Capillary Plasma Source for Laser-Driven Plasma Acceleration," Proceedings of IPAC'10, Kyoto, Japan, pp. 4071-4073.
Leemans et al., "GeV electron beams from a centimetre-scale accelerator," Nature Physics, vol. 2, pp. 696-699, (Sep. 24, 2006).
Leemans et al., "Multi-GeV Electron Beams from Capillary-Discharge-Guided Subpetawatt Laser Pulses in the Self-Trapping Regime," Physical Review Letters, vol. 113, pp. 245002-1-245002-5, (Dec. 12, 2014).
Albert et al., "Laser wakefield accelerator based light sources: potential applications and requirements," Plasma Physics and Controlled Fusion, vol. 56, pp. 1-10, (Dec. 8, 2014).
Malka, "Review of Laser Wakefield Accelerators," Proceedings of IPAC2013, Shanghai, China, pp. 11-13 (2013).
Chiou et al., "Laser wake-field acceleration and optical guiding in a hollow plasma channel," Physics of Plasmas, vol. 2, No. 1, pp. 310-318, (Sep. 15, 1994).
Chiou et al., "Stability of intense laser propagation in an underdense hollow channel plasma," Physics of Plasmas, vol. 3, No. 5, pp. 1700-1708, (May 1996).
Benedetti et al., "Quasi-matched propagation of ultra-short, intense laser pulses in plasma channels," Physics of Plasmas, vol. 19, pp. 053101-1-053101-8, (May 4, 2012).

* cited by examiner

FIG. 19A
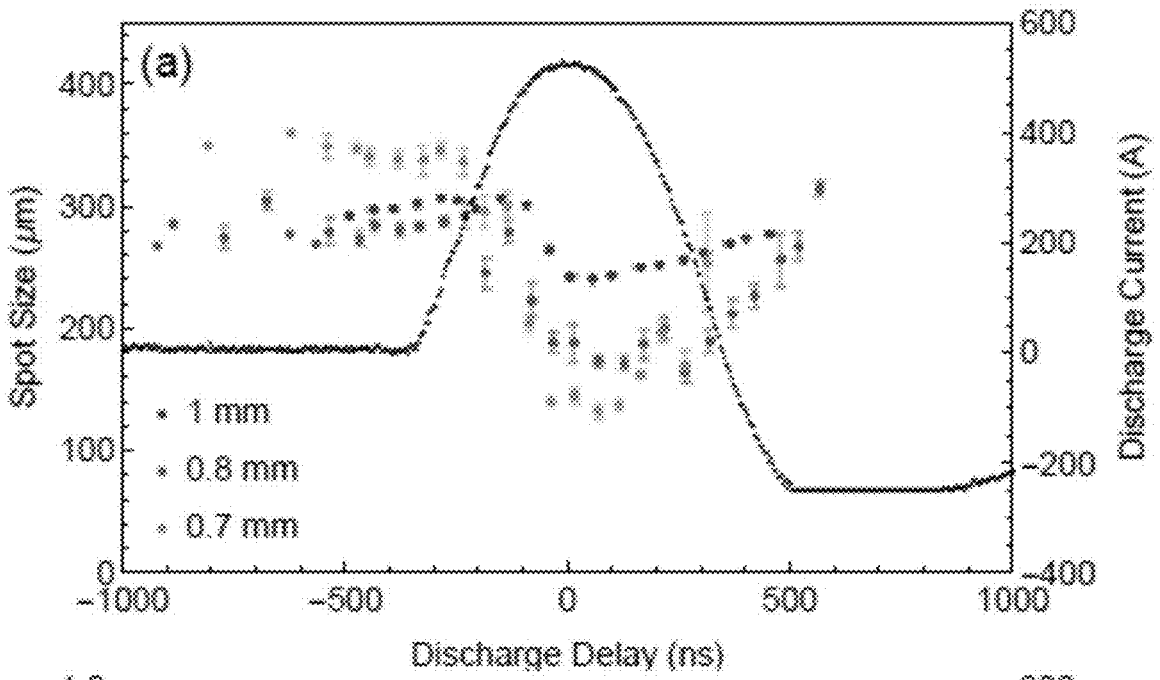
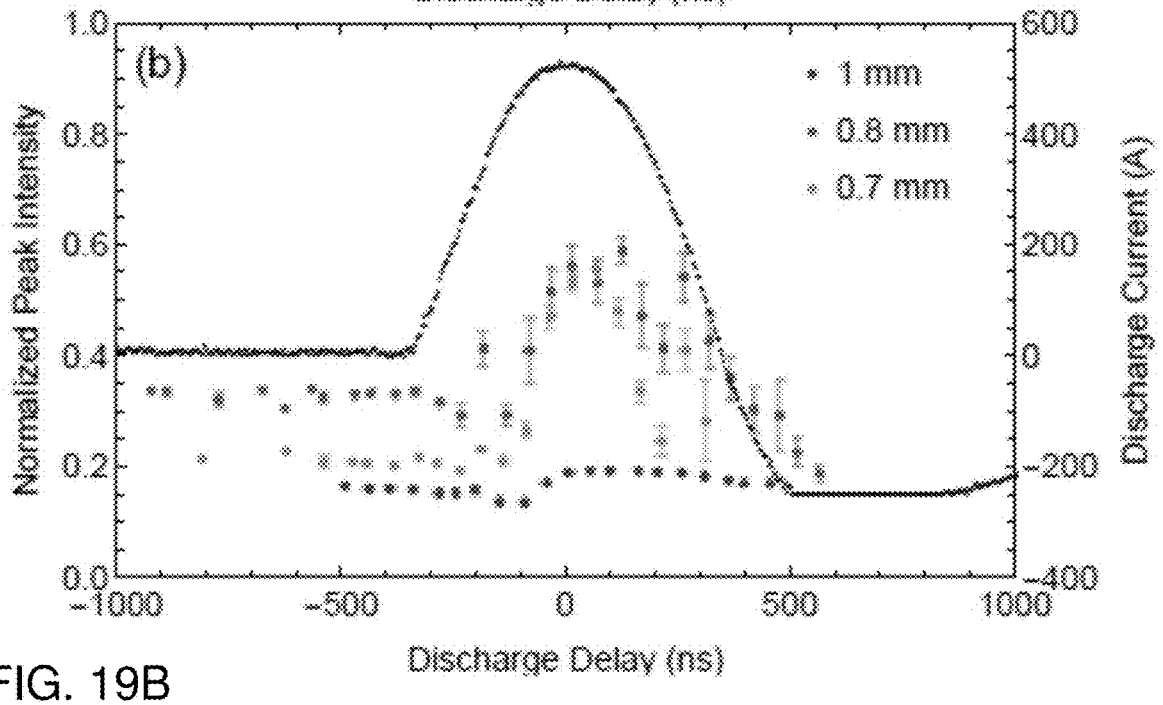
FIG. 19B

FIG. 20A
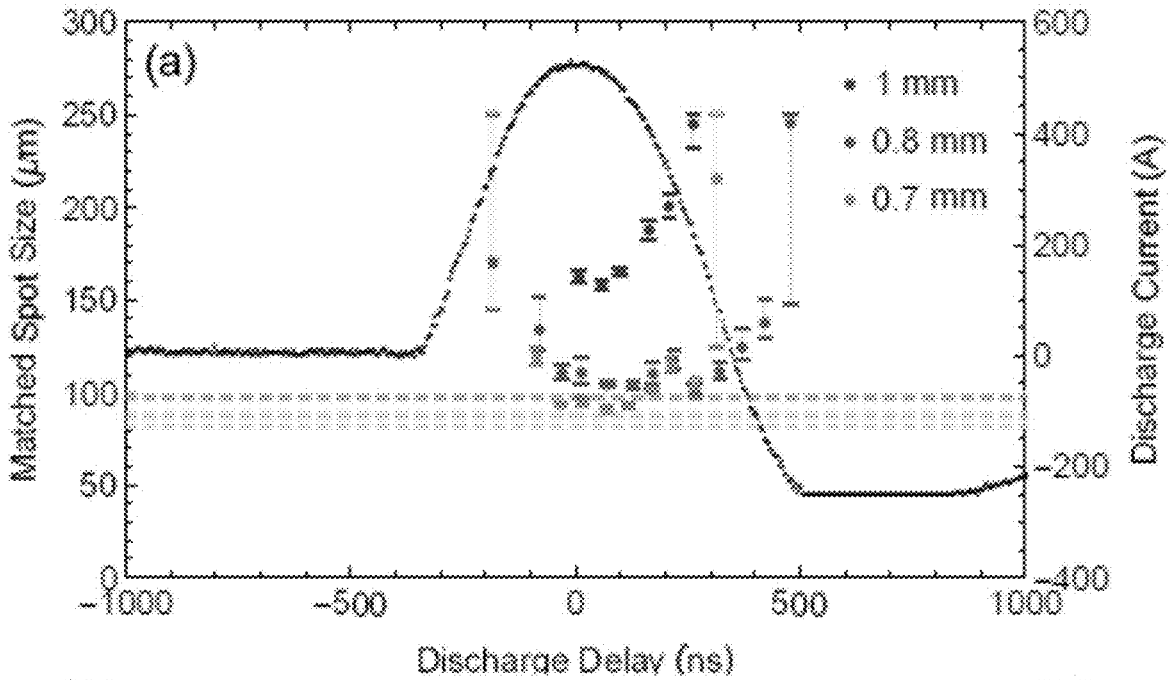
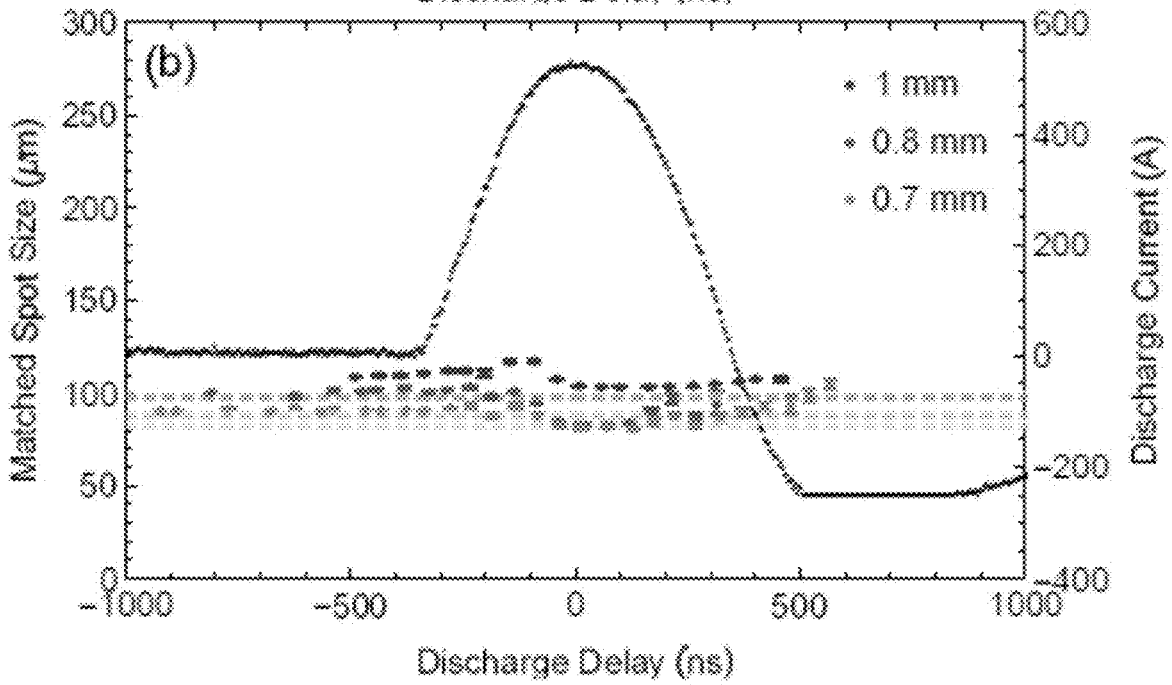
FIG. 20B

DEVICES AND METHODS FOR CREATING PLASMA CHANNELS FOR LASER PLASMA ACCELERATION

RELATED APPLICATIONS

This application claims priority to U.S. Provisional Patent Application No. 62/935,777, filed Nov. 15, 2019, which is herein incorporated by reference.

STATEMENT OF GOVERNMENT SUPPORT

This invention was made with government support under Contract No. DE-AC02-05CH11231 awarded by the U.S. Department of Energy. The government has certain rights in this invention.

TECHNICAL FIELD

This disclosure relates generally to laser plasma acceleration and more particularly to plasma channels for laser plasma acceleration.

BACKGROUND

The capability of conventional particle accelerators to probe higher energies is limited by breakdown in the radio frequency (RF) cavities, restricting the maximum achievable acceleration gradient. Laser plasma acceleration is a technique in which particles are accelerated by the electric field of a plasma wave generated by an intense laser pulse. Laser plasma acceleration has been shown to produce acceleration gradients several orders of magnitude greater than those found in RF cavities. For this reason, laser plasma accelerators (LPAs) have been investigated for their potential to reduce the size and cost of future colliders.

For LPAs to be applicable to high-energy physics, both electrons and positrons must be efficiently accelerated while maintaining high beam quality. Even though substantial progress has been made in accelerating electrons, emittance degradation remains a challenge. The transverse plasma fields induce focusing forces on the beam such that a strong focusing force results in high beam densities that cause the background ions to move, inducing emittance growth. Weak focusing, however, causes emittance growth due to Coulomb scattering from the on-axis ions. Emittances down to 0.1 mm mrad using LPAs have been achieved, which is equivalent to state-of-the-art conventional accelerators. However, LPAs have the potential to achieve orders of magnitude better.

In addition, commonly used nonlinear regimes for electron acceleration are inadequate for accelerating positrons. First, the phase within the plasma wake over which positrons can be accelerated is much smaller than that for electrons. This small phase region makes it challenging to accelerate positrons efficiently. Second, unlike electrons, positrons always experience an energy spread due to transverse inhomogeneities in the accelerating field of the wake. Such problems do not occur in the linear regime, but this regime has a lower efficiency and smaller accelerating fields.

SUMMARY

Capillary discharge technology has been used to reach record setting electron beam energies from laser plasma accelerators. The hollow or near-hollow plasma channel technology can potentially mitigate one of the challenges of capillary discharge technology—operation at sufficiently low plasma density to reach high electron beam energies while simultaneously providing good guiding and protection of the walls that confine the plasma.

Achieving the goals efficiently accelerating electrons and positrons while maintaining high beam quality can be addressed using a hollow plasma channel or a near-hollow plasma channel. Hollow plasma channels have been theoretically shown to mitigate beam degradation and efficiently accelerate positrons.

A cryogenically cooled hollow plasma channel, along with methods for tuning the channel to match the laser and particle beam, is described herein. Demonstrating laser guiding to maintain a high intensity throughout the hollow plasma channel is also described. The hollow plasma channel has the potential to advance LPA technology and make it more versatile for previously inaccessible applications.

Parabolic plasma channels are also described herein. Instead of having sharp walls and no density on-axis, the density profile is parabolic.

One innovative aspect of the subject matter described in this disclosure can be implemented in a device including a block of material and a cooling system. The block of material defines a channel having a cylindrical shape and having a first open end and a second open end. An axis of the channel lies along a straight line. The block of material further defines a first gas port and a second gas port, with the first gas port and the second gas port being in fluid communication with channel. The cooling system is operable to cool the channel to below the freezing point of a gas.

Another innovative aspect of the subject matter described in this disclosure can be implemented in a method including cooling a material defining a channel to below a freezing point of a gas. The channel has a cylindrical shape and has a first open end and a second open end. An axis of the channel lies along a straight line. A gas is introduced to the channel, with the gas freezing on the material defining the channel.

Details of one or more embodiments of the subject matter described in this specification are set forth in the accompanying drawings and the description below. Other features, aspects, and advantages will become apparent from the description, the drawings, and the claims. Note that the relative dimensions of the following figures may not be drawn to scale.

BRIEF DESCRIPTION OF THE DRAWINGS

FIGS. 19A and 19B shows examples of the measured beam parameters at the exit of capillary as a function of discharge timing for varying channel diameters. FIG. 19A shows the spot size and FIG. 19B shows the normalized peak intensity.

FIGS. 20A and 20B show the matched spot size as a function of discharge timing for varying channel diameters using the exit spot size (FIG. 20A) and the normalized peak intensity (FIG. 20B). Matched spot size at steady state from theory is shown as dashed lines.

DETAILED DESCRIPTION

Reference will now be made in detail to some specific examples of the invention including the best modes contemplated by the inventors for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments of the present invention may be implemented without some or all of these specific details. In other instances, well known process operations have not been described in detail in order not to obscure the present invention.

Various techniques and mechanisms of the present invention will sometimes be described in singular form for clarity. However, it should be noted that some embodiments include multiple iterations of a technique or multiple instantiations of a mechanism unless noted otherwise.

The terms "about" or "approximate" and the like are synonymous and are used to indicate that the value modified by the term has an understood range associated with it, where the range can be ±10%, ±5%, or ±1%. The term "substantially" is used to indicate that a value is close to a targeted value, where close can mean, for example, the value is within 90% of the targeted value, within 95% of the targeted value, or within 99% of the targeted value.

Figure 1:
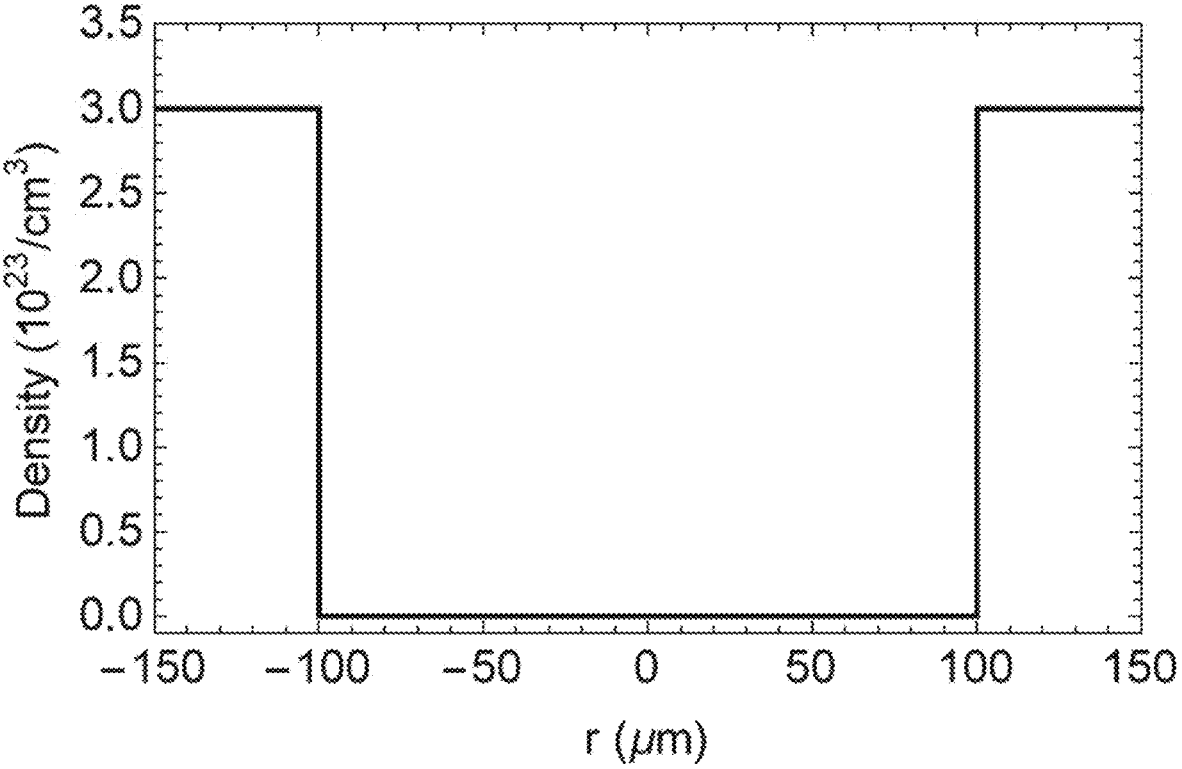
FIG. 1 shows an example of a hollow plasma channel in a plot of plasma density versus radius.

A hollow plasma channel has been theoretically proposed as a solution to problems with LPAs. A hollow plasma channel has zero plasma density within the channel and constant plasma density on the walls (FIG. 1). A hollow plasma channel has capabilities including guiding a laser, symmetrically accelerating both electrons and positrons, offering independent control of longitudinal and transverse fields inside the hollow plasma channel, and maintaining low beam emittance. A hollow plasma channel behaves like an optical fiber, providing guiding for the driving laser. This allows the laser to remain intense enough to excite large amplitude plasma waves over many Rayleigh lengths.

One limitation to energy gain in an LPA is the effective reduction of the laser plasma interaction distance caused by the diffraction of the laser pulse as it propagates. Without any form of guiding, the distance the laser will remain intense enough to drive a wake is limited to its Rayleigh range, which is only a few millimeters for a 800 nanometer (nm) laser with a beam spot size of 25 microns. Relativistic self-guiding can extend this interaction length but is susceptible to nonlinear effects such as erosion of the leading edge of the pulse. A hollow plasma channel has been theoretically shown to confine the laser pulse like an optical fiber while suppressing Raman, modulation, and hosing instabilities. Matching the hollow plasma channel radius to the laser mode enables mono-mode propagation of the laser and reduces losses from the channel. Therefore, a laser propagating in a hollow plasma channel can drive a large amplitude plasma wave over an extended distance.

The excited plasma wave possesses desirable accelerating and focusing properties for both electrons and positrons. Laser-induced surface currents in the hollow plasma channel wall produce an accelerating force on-axis. The accelerating field is controlled by the wall plasma density and is transversely uniform, minimizing the energy spread caused by the radial extent of the particle beam. The on-axis channel density determines the strength of the focusing force, allowing for independent control over the particle beam acceleration and focusing. In this configuration, the wake is symmetric for both electrons and positrons, increasing the efficiency of the accelerator.

When the hollow plasma channel is evacuated, or nearly evacuated, the focusing field is weak and transversely linear, mitigating normalized transverse emittance growth. Theoretically, in a hollow plasma channel with a wall density of $10^{17}$ $cm^{-3}$, particles with TeV-level energies can achieve a normalized emittance on the order of 0.01 mm mrad, which is several orders of magnitude better than found in conventional accelerators. In a near-hollow plasma channel with a channel density on the order of $10^{10}$ $cm^{-3}$, the emittance growth can approach $10^{-6}$ mm mrad due to an increase in focusing. Therefore, hollow plasma channels can improve upon the ultra-low emittance needed for high-energy physics as well as any other application that requires high quality particle beams, such as nuclear physics and laboratory astrophysics.

Despite the many benefits, there are few apparatus designs for generating a hollow plasma channel. Hollow plasma channels have been created using higher-order Bessel laser beams. Hollow plasma channels also have been theoretically studied using obstructions in gas flow from a jet. However, these techniques produce hollow plasma channels that are still partially filled, and the tunability of these techniques is limited, hindering the ability to control the laser and particle beam propagation.

As described herein, in some embodiments, a gas-filled capillary (i.e., a tube having a small diameter) that is cooled (e.g., with liquid nitrogen) generates a frozen gas layer (i.e., a solid state of matter) on internal walls of the capillary. In some embodiments, an electrical discharge is operable to ionize the frozen gas layer, developing a hollow plasma channel. Such an apparatus can provide independent, dynamic control over the channel profile, allowing for precise confinement of the laser.

In embodiments described herein, cryogenically cooled tubes or capillary discharge systems of various diameters can be used to create hollow, near-hollow, and parabolic plasma channels by freezing gas onto the interior walls of the tubes or capillaries. The frozen gas layer would be ionized by a laser beam propagating down the tube or by a low current discharge, turning the frozen layer into a plasma of high density. The high-density plasma would provide the medium in which a high intensity laser pulse could excite high electric fields. The high electric fields could be used to accelerate particles. Additionally, the high-density plasma near the walls of the tube would provide a protective layer for the solid-state material that confines the plasma. The laser light could damage the walls of the tube, but the density of the plasma would be too high for deep penetration by the laser light.

In embodiments described herein, to create near-hollow plasma channels, a second gas having a freezing point below the temperature of the cryogenically cooled tube could be added to the interior of the tube. For example, a sapphire tube could be cooled. The tube could be cooled to 77 K using liquid nitrogen or to lower temperatures using a liquid He-cooled cryostat. The tube would initially be filled with a gas that has a freezing point above the temperature of the cooled walls that would freeze on to the walls. A small amount of helium gas could then be input to the tube. A laser beam having sufficient intensity to cause instantaneous ionization of the helium gas could be injected into the tube. The tube could have a length of centimeters to tens of centimeters and diameter of one hundred microns to millimeters.

Figure 2:
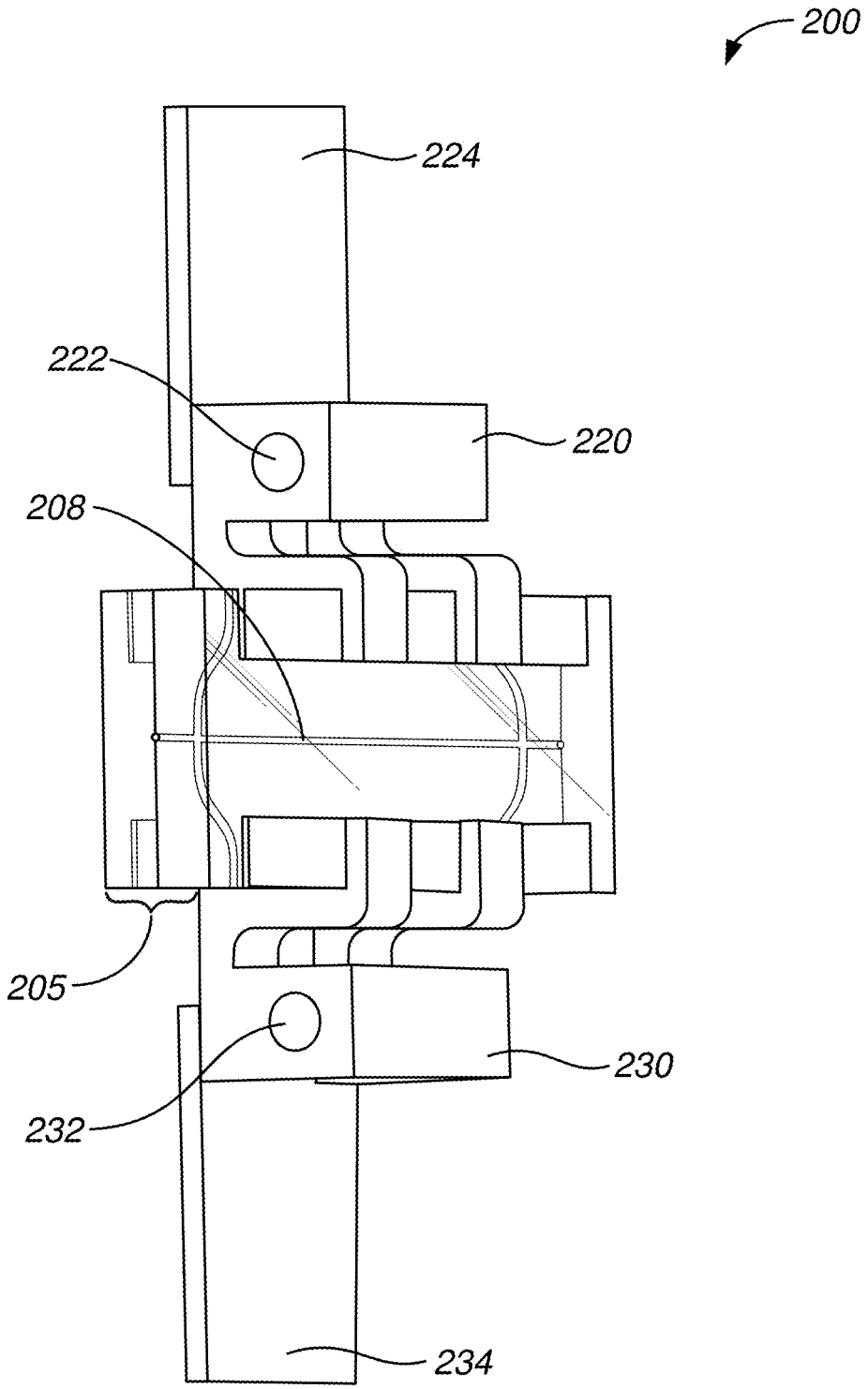
FIGS. 2-4 show examples of schematic illustrations of a plasma channel device without end electrodes.
Figure 3:
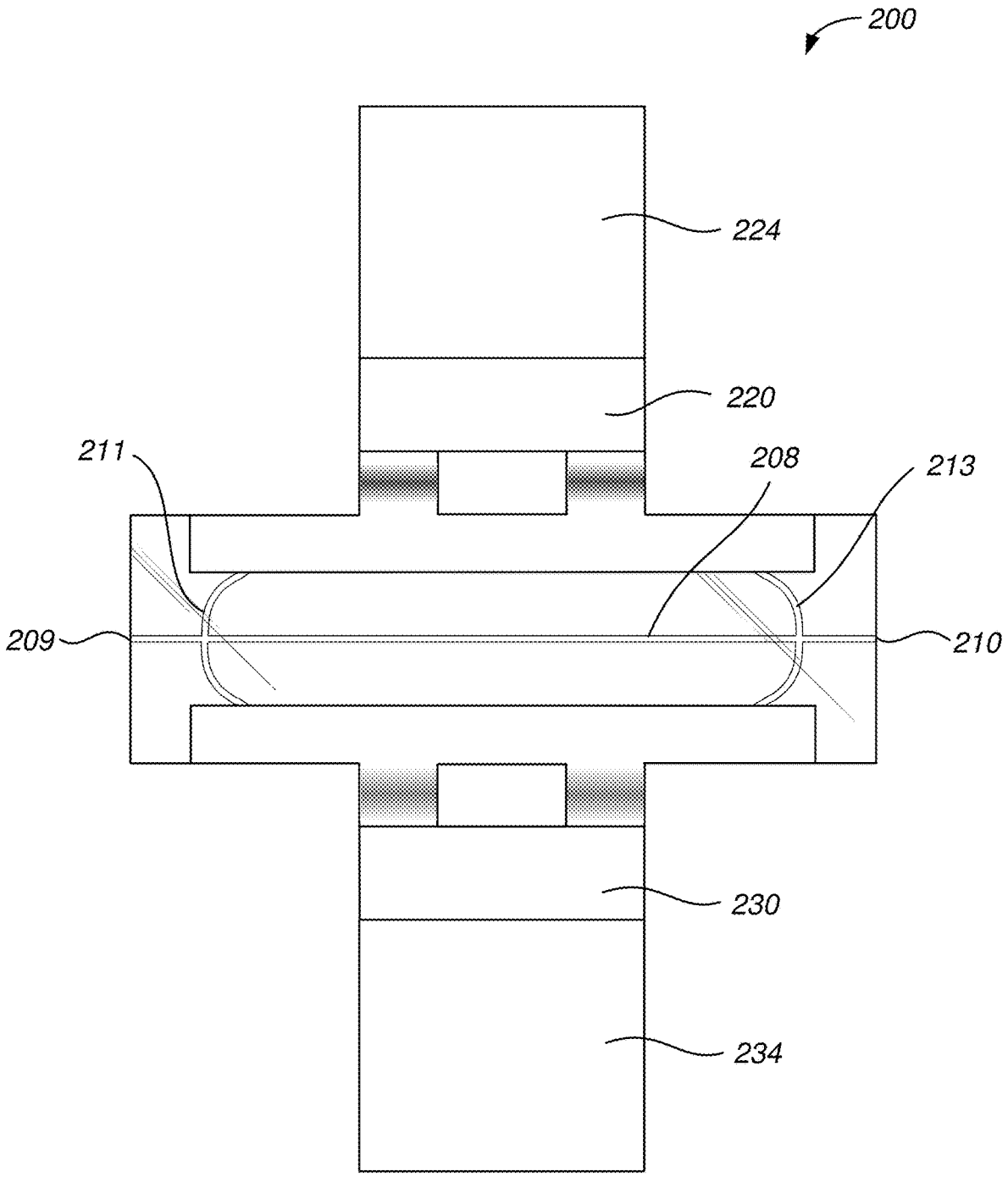
Figure 4:
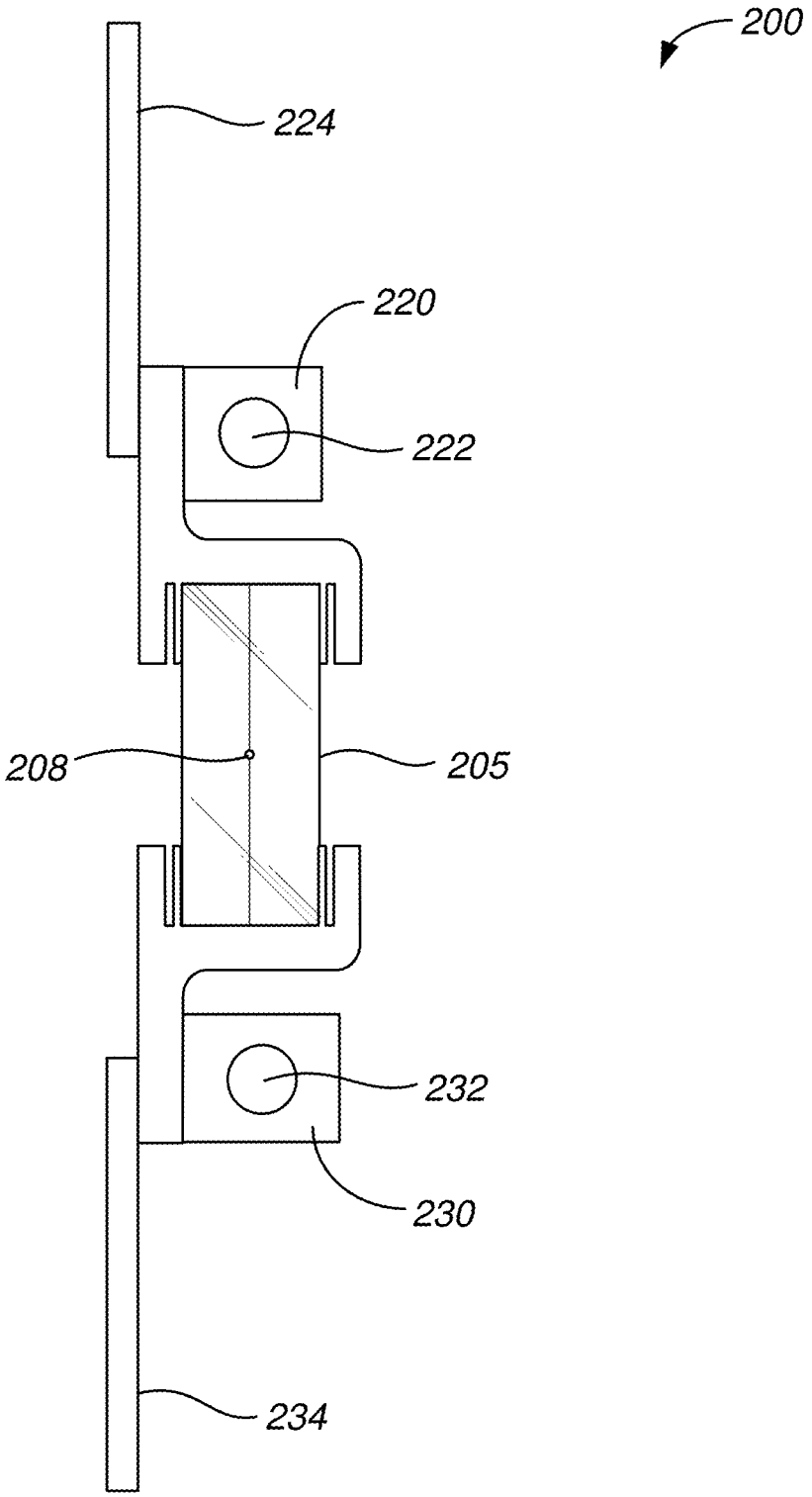

FIGS. 2-4 show examples of schematic illustrations of a plasma channel device without end electrodes. FIG. 2 shows an example of an isometric view of the plasma channel device. FIG. 3 shows an example of a side view of the plasma channel device. FIG. 4 shows an example of an end view of the plasma channel device.

Figure 5:
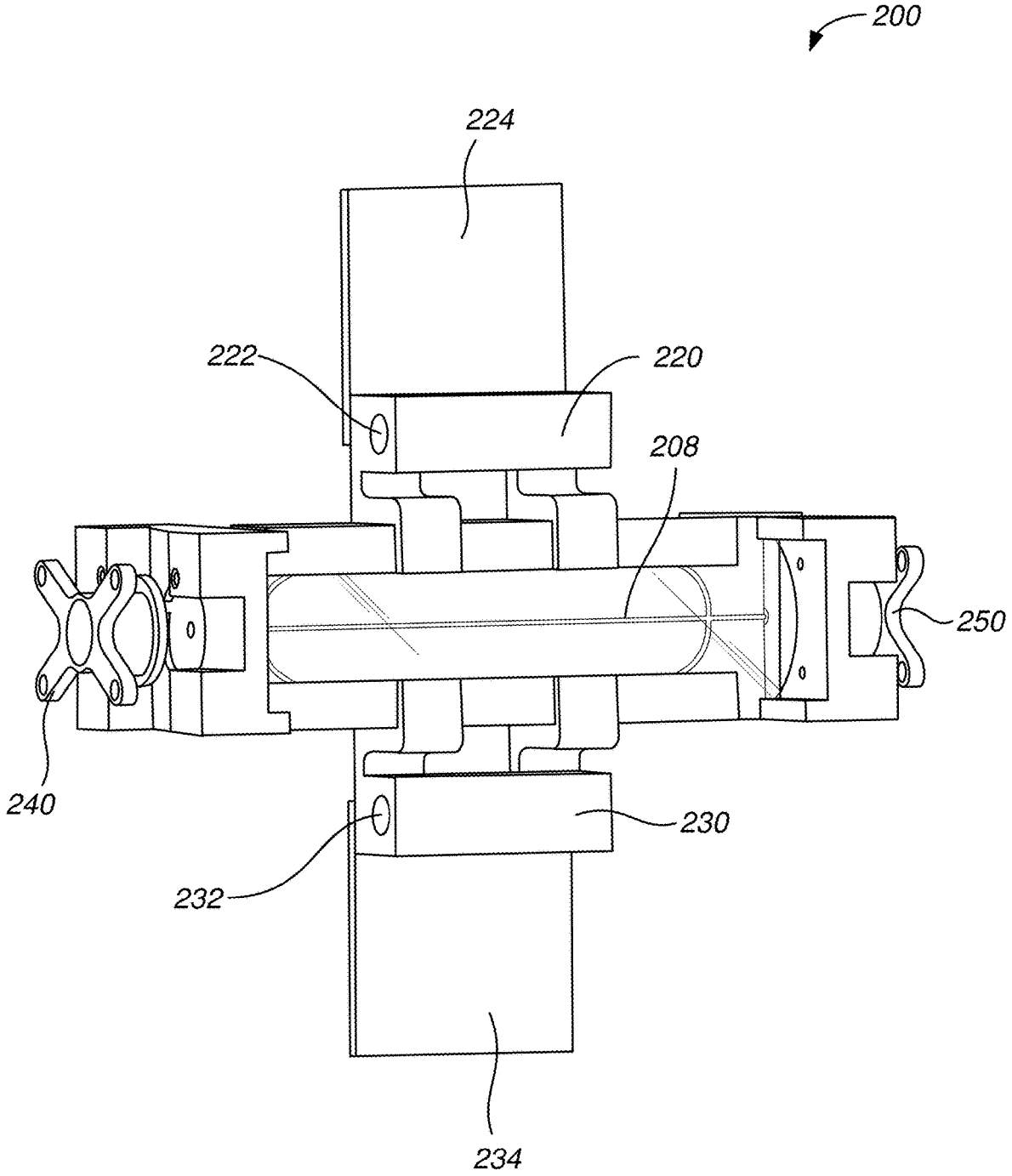
FIGS. 5-7 show examples of schematic illustrations of a plasma channel device including end electrodes.
Figure 6:
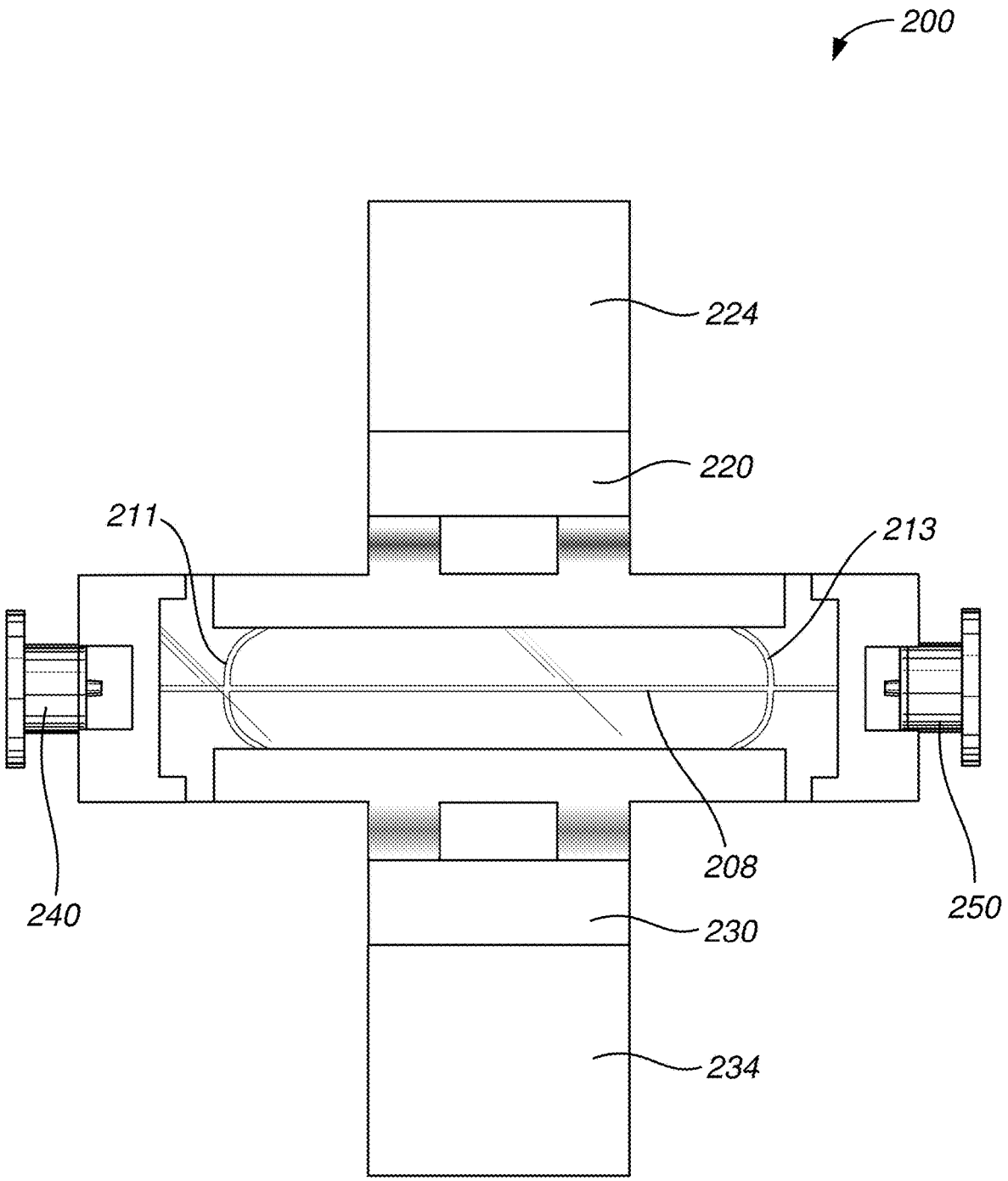
Figure 7:
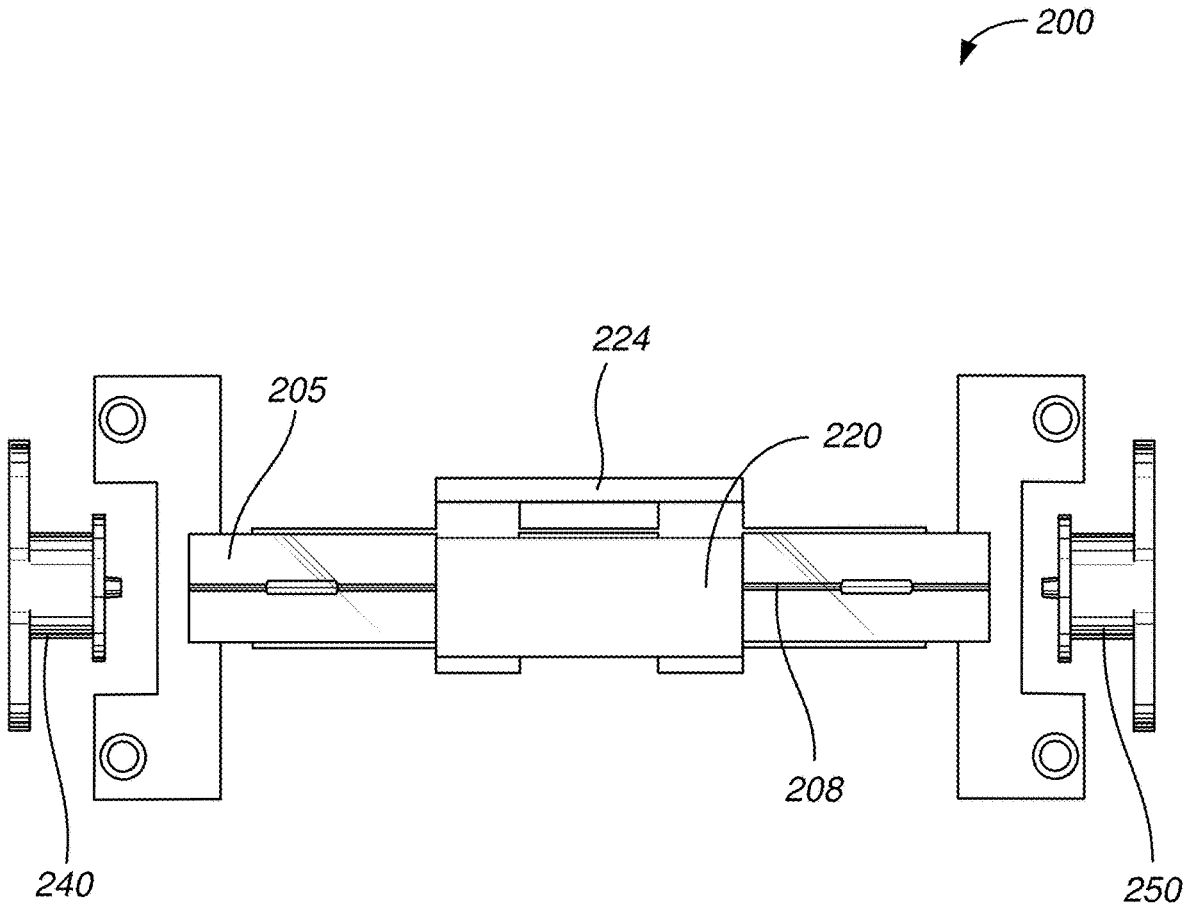

FIGS. 5-7 show examples of schematic illustrations of a plasma channel device including end electrodes. FIG. 5 shows an example of an isometric view of the plasma channel device. FIG. 6 shows an example of a side view of the plasma channel device. FIG. 7 shows an example of a top-down view of the plasma channel device.

Figure 8:
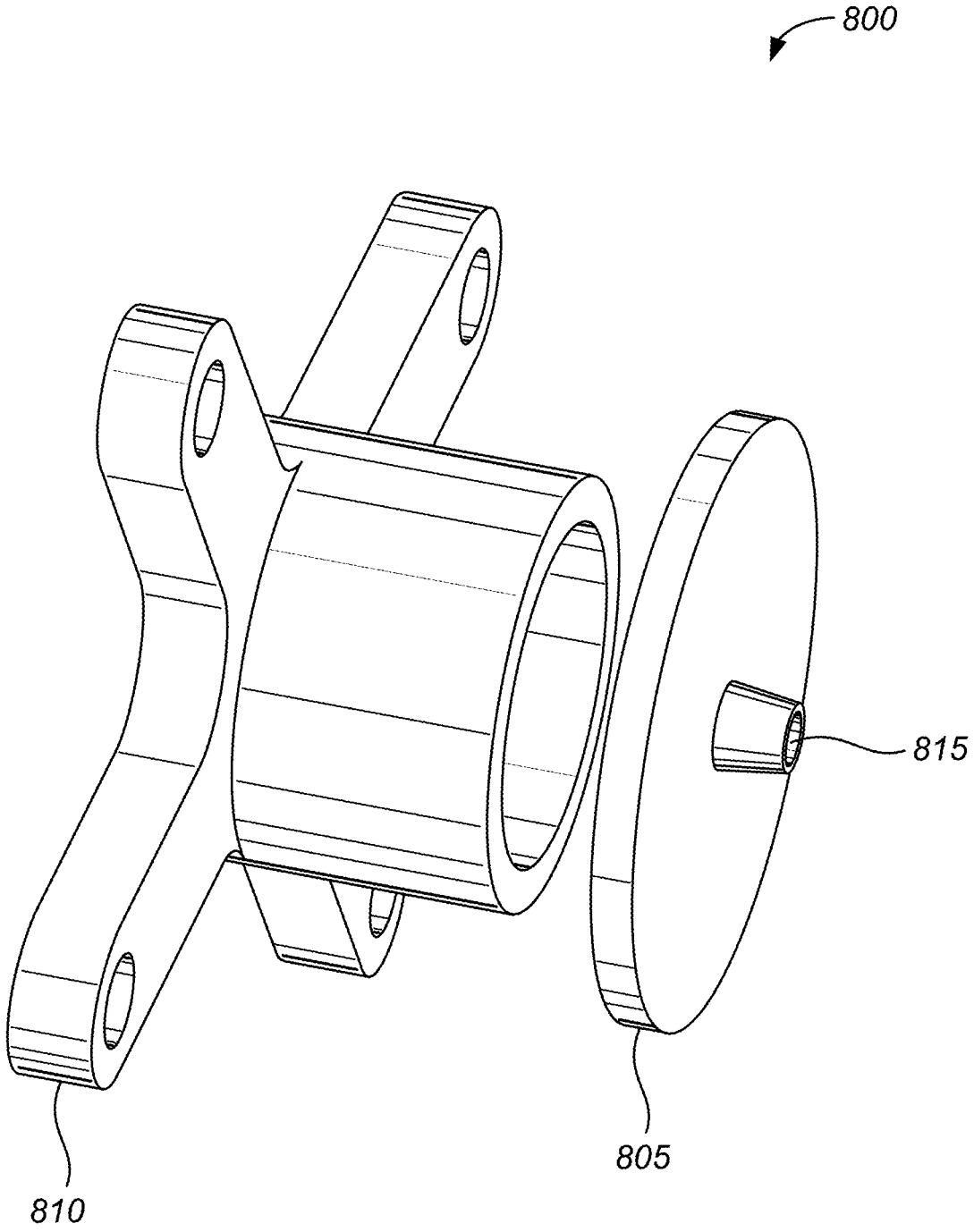
FIG. 8 shows an example of a schematic illustration of an electrode assembly of a plasma channel device.
Figure 9:
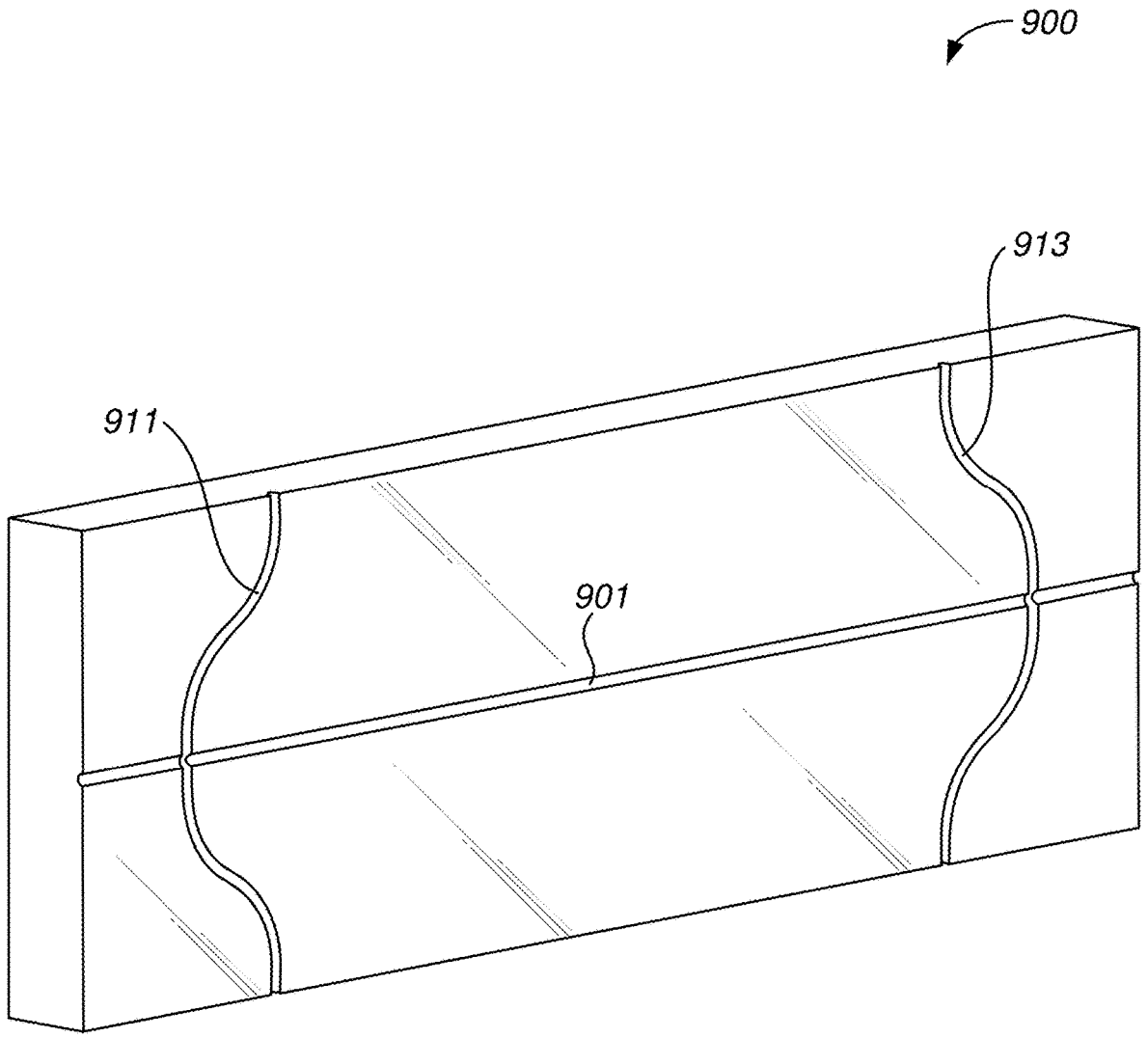
FIG. 9 shows an example of a schematic illustration of one of the smaller blocks of material that make up the block of material of a plasma channel device.

FIG. 8 shows an example of a schematic illustration of an electrode assembly of a plasma channel device. FIG. 9 shows an example of a schematic illustration of one of the smaller blocks of material that make up the block of material of a plasma channel device.

As shown in FIG. 2-7, a plasma channel device 200 includes a block of material 205. In some embodiments, the plasma channel device 200 includes a cooling system (not shown) operable to cool the channel of the device 200 to below the freezing point of a gas. For example, when nitrous oxide ($N_2O$) is used with the plasma channel device 200, the cooling system is operable to cool the channel of the device 200 to about −155° C. or lower. When carbon dioxide ($CO_2$) is used with the plasma channel device 200, the cooling system is operable to cool the channel of the device 200 to about −50° C. or lower.

In some embodiments, the cooling system comprises a first metal block 220 in contact with the block of material 205 and a second metal block 230 in contact with the block of material 205. In some embodiments, the first metal block 220 is in contact with a first side of the block of material 205, and the second metal block 230 in contact with a second side of the block of material 205 opposite the first side. In some embodiments, the first metal block 220 and the second metal block 230 lie along the axis of a channel 208.

The block of material 205 defines the channel 208 having a first open end 209 and a second open end 210. An axis of the channel 208 lies along a straight line. The block of material 205 further defines a first gas port 211 and a second gas port 213. The first gas port 211 and the second gas port 213 are in fluid communication with the channel 208. In some embodiments, the device 200 includes a gas system (not shown) connected to the first gas port 211 and the second gas port 213, wherein the gas system is operable to inject a gas into the channel. In some embodiments, the gas system is connected to the top openings of the first gas port 211 and the second gas port 213. In some embodiments, a first pressure gauge is connected to the bottom opening the first gas port 211 and a second pressure gauge is connected to the bottom opening the second gas port 213. From the pressure readings at the first gas port 211 and the second gas port 213, a density of gas in the channel 208 can be determined.

In some embodiments, the channel is a cylinder or a right circular cylinder.

Geometrically, a cylinder obtained by rotating a line segment about a fixed line that it is parallel to is a cylinder of revolution. In some embodiments, the channel 208 has a length of about 1 centimeter (cm) to about 50 cm, 1.5 cm to 12 cm, or about 1.5 cm to 9 cm. In some embodiments, the channel 208 has diameter of about 100 microns to 5 millimeters (mm), or about 1 mm.

In some embodiments, the block of material 205 comprises acrylic, glass, aluminum, or sapphire. Sapphire has a high thermal conductivity. Sapphire is also transparent, allowing for imaging of a gas freezing on walls defining the channel 208.

In some embodiments, the blocks of metal 220 and 230 comprise aluminum or copper. In some embodiments, each of the blocks of metal 220 and 230 define liquid channels through with liquid nitrogen can flow to cool to the block of material 205. The first block of metal 220 defines a liquid channel 222 and the second block of metal 230 defines a liquid channel 232. Also, so that the temperature of the channel 208 can be controlled and not only at the temperature of the liquid used to cool the block of material 205, in some embodiments, heaters (not shown) are connected to each of the blocks of metal. The first block of metal 220 is in contact with a first heater (not shown) through metal contact 224. The second block of metal 230 is in contact with a second heater (not shown) through metal contact 234. In some embodiments, the cooling system of the plasma channel device 200 includes a cryostat in contact with the blocks of metal 220 and 230.

In some embodiments, the plasma channel device 200 includes a first electrode assembly 240 proximate the first open end of the channel and a second electrode assembly 250 proximate the second open end of the channel. FIG. 8 shows an example of a schematic illustration of an electrode assembly. As shown in FIG. 8, an electrode assembly 800 includes an electrode 805 and an electrode mount 810. The electrode 805 defines an electrode aperture 815. In some embodiments, the electrode 805 comprises a metal (e.g., stainless steel). In some embodiments, the electrode 805 is not in contact with the block of material. For example, in some embodiments, the electrode 805 is positioned about 0.1 mm to 1.5 mm from the block of material 205. In some embodiments, the plasma channel device 200 includes a power source (not shown) connected to a first electrode and a second electrode.

In some embodiments, the plasma channel device 200 further includes a first insulator (not shown) disposed between the block of material 205 and the first electrode and a second insulator (not shown) disposed between the block of material 205 and the second electrode. In some embodiments, the first insulator defines a first insulator aperture and the second insulator defines a second insulator aperture. In some embodiments, the first insulator and the second insulator comprise a ceramic. The first and the second insulators can help to prevent arcing to other metal parts of or surrounding the plasma channel device 200 when a voltage is applied across the first and the second electrodes. In some embodiments, the first and the second electrodes are not in contact with the first and the second insulators. In some embodiments, the first and the second electrodes are heated. For example, in some embodiments, a heater is in contact with the first electrode and the second electrode or the first and the second electrodes are heated with a laser.

In some embodiments, the block of material 205 comprises two smaller blocks of material. Features defining the channel 208, the first gas port 211, and the second gas port 213 can be formed in each of the two smaller blocks of material. Then, the two smaller blocks are joined together (e.g., with pressure or with an adhesive, such as epoxy) to form the block of material 205. In some embodiments, each of the smaller blocks of material is about ¼ inch thick. FIG. 9 shows an example of a schematic illustration one of the smaller blocks of material that make up the block of material. The smaller block of material 900 includes features defining the channel 908, the first gas port 911, and the second gas port 913.

In some embodiments, the block of material 205 is held in a holder (e.g., an acrylic holder). It some embodiments, the holder applies pressure to hold two smaller blocks of material together to form the block of material 205.

Figure 21A:
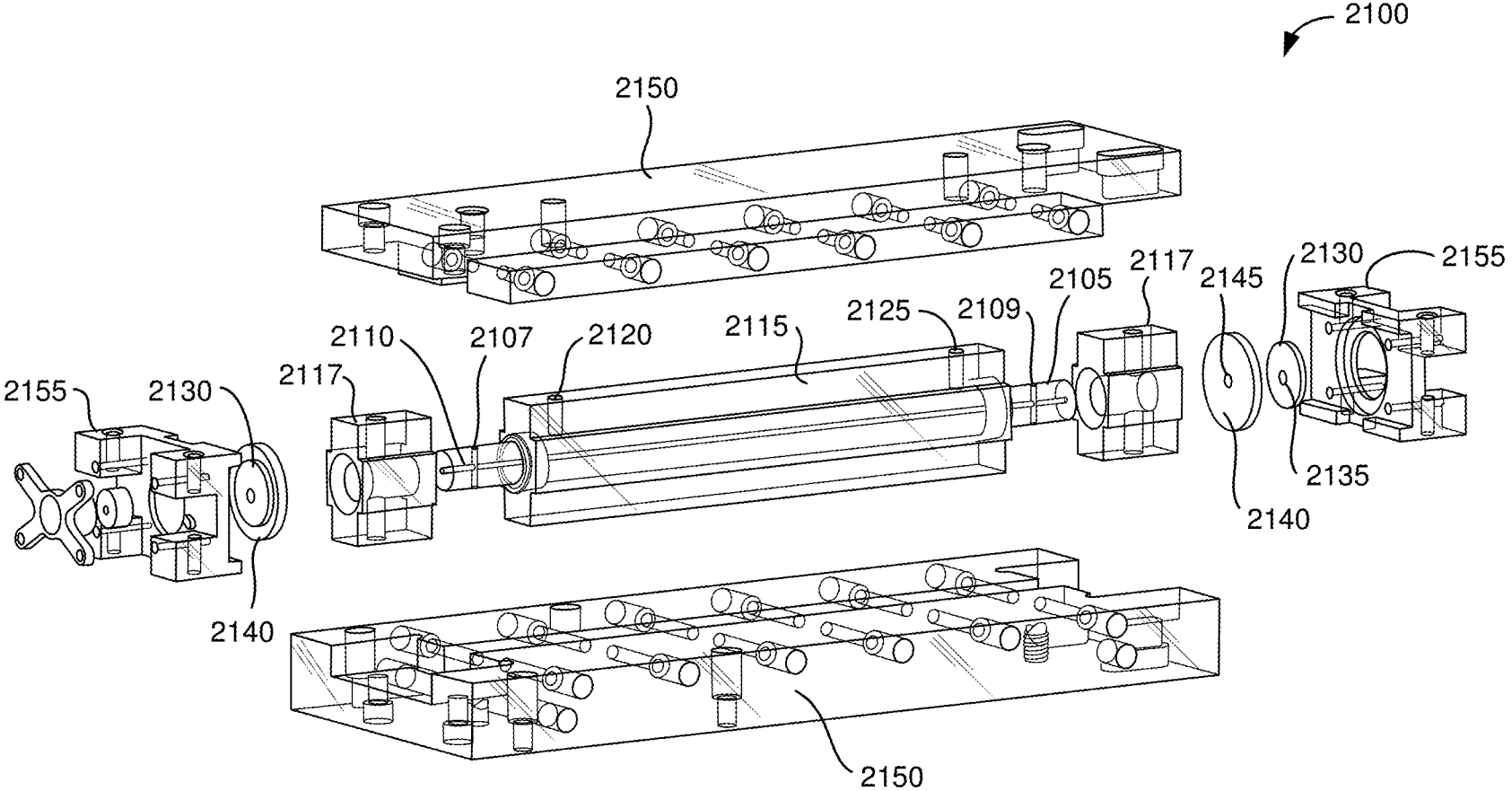
FIGS. 21A-21E show examples of schematic illustrations of a plasma channel device.
Figure 21B:
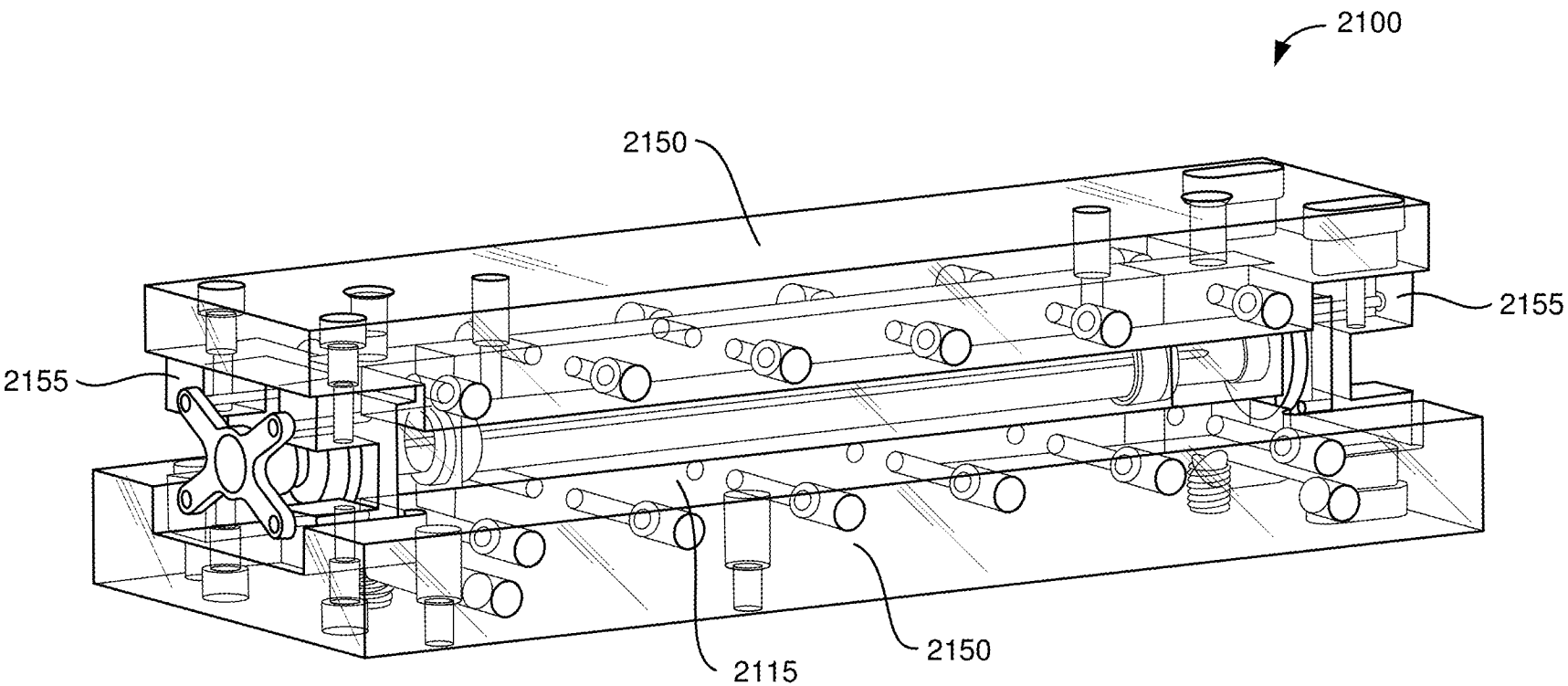
Figure 21C:
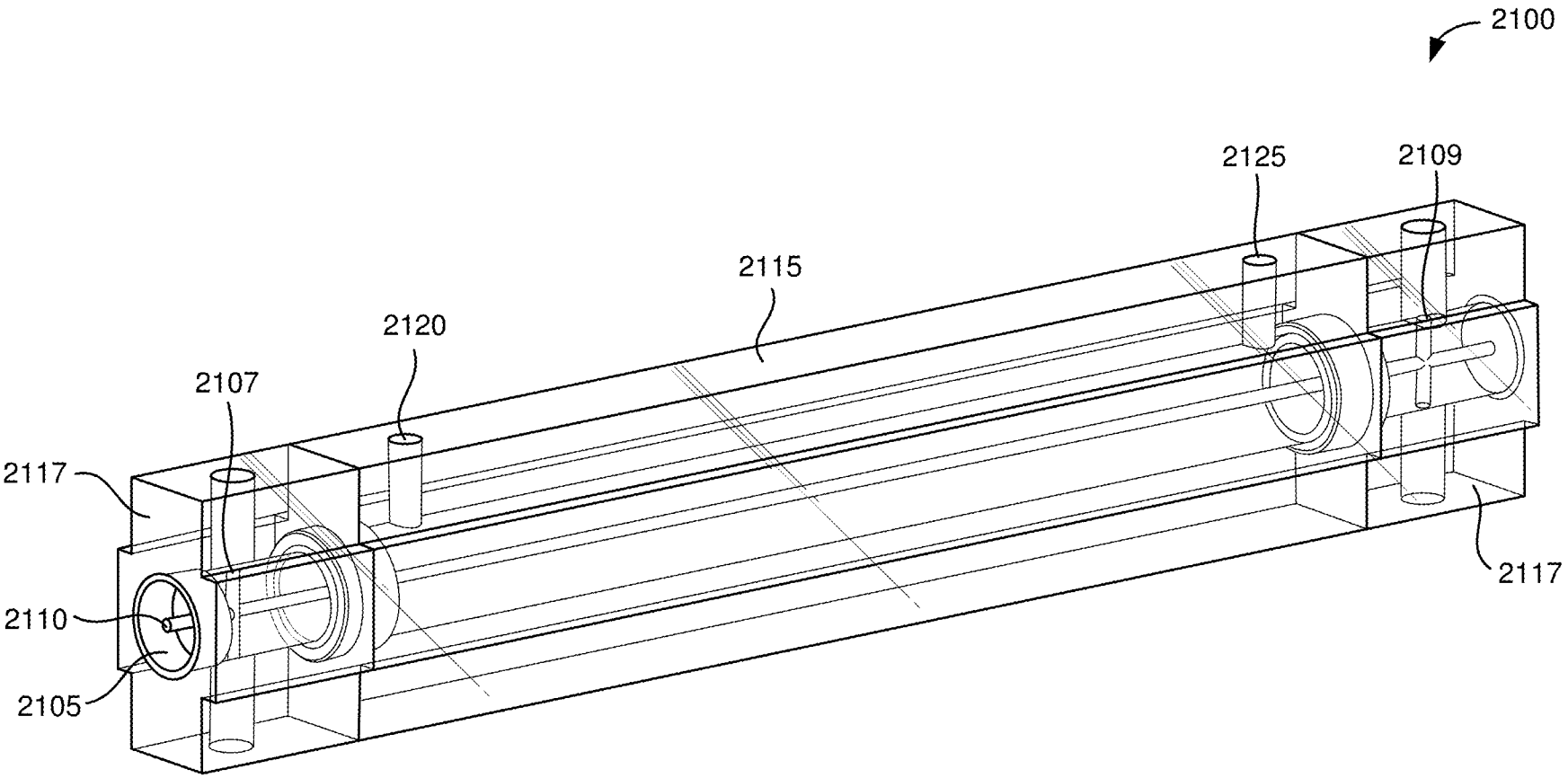
Figure 21D:
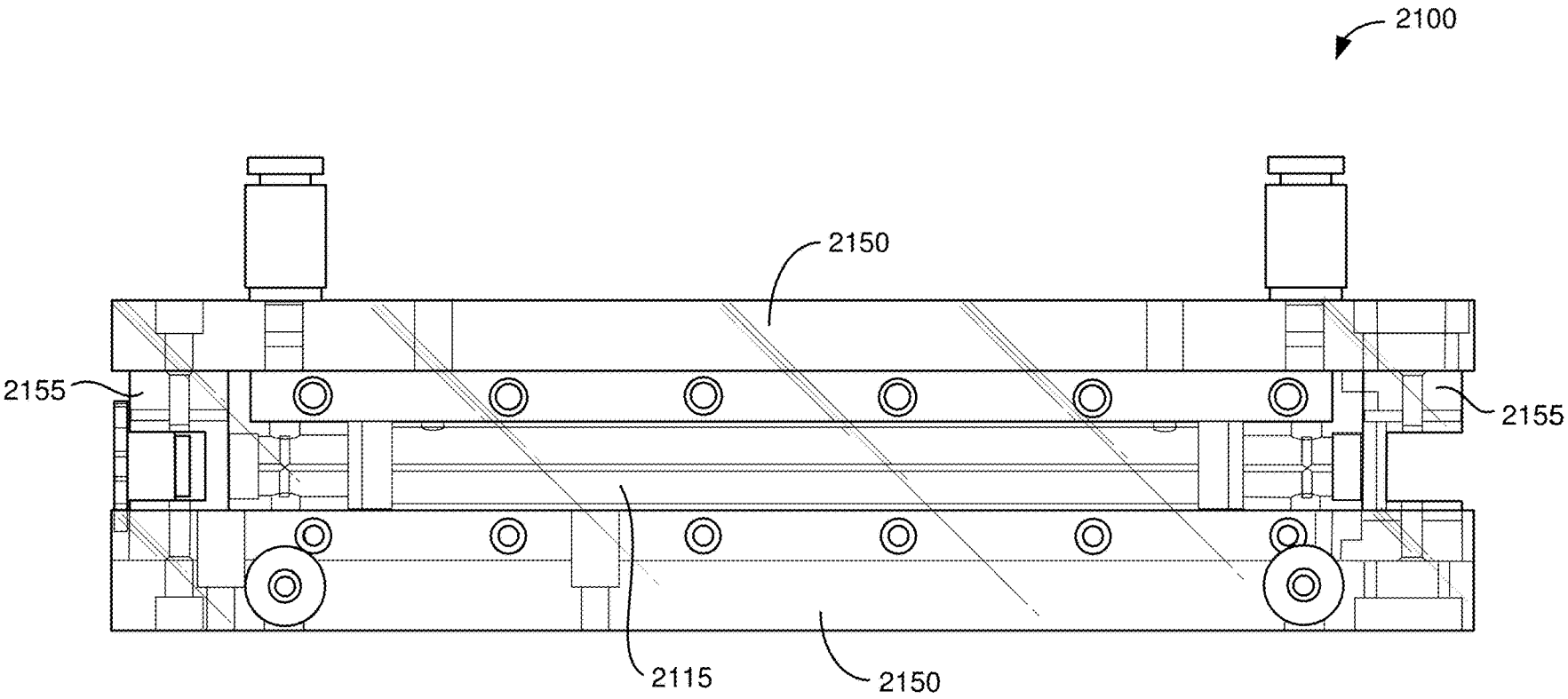
Figure 21E:
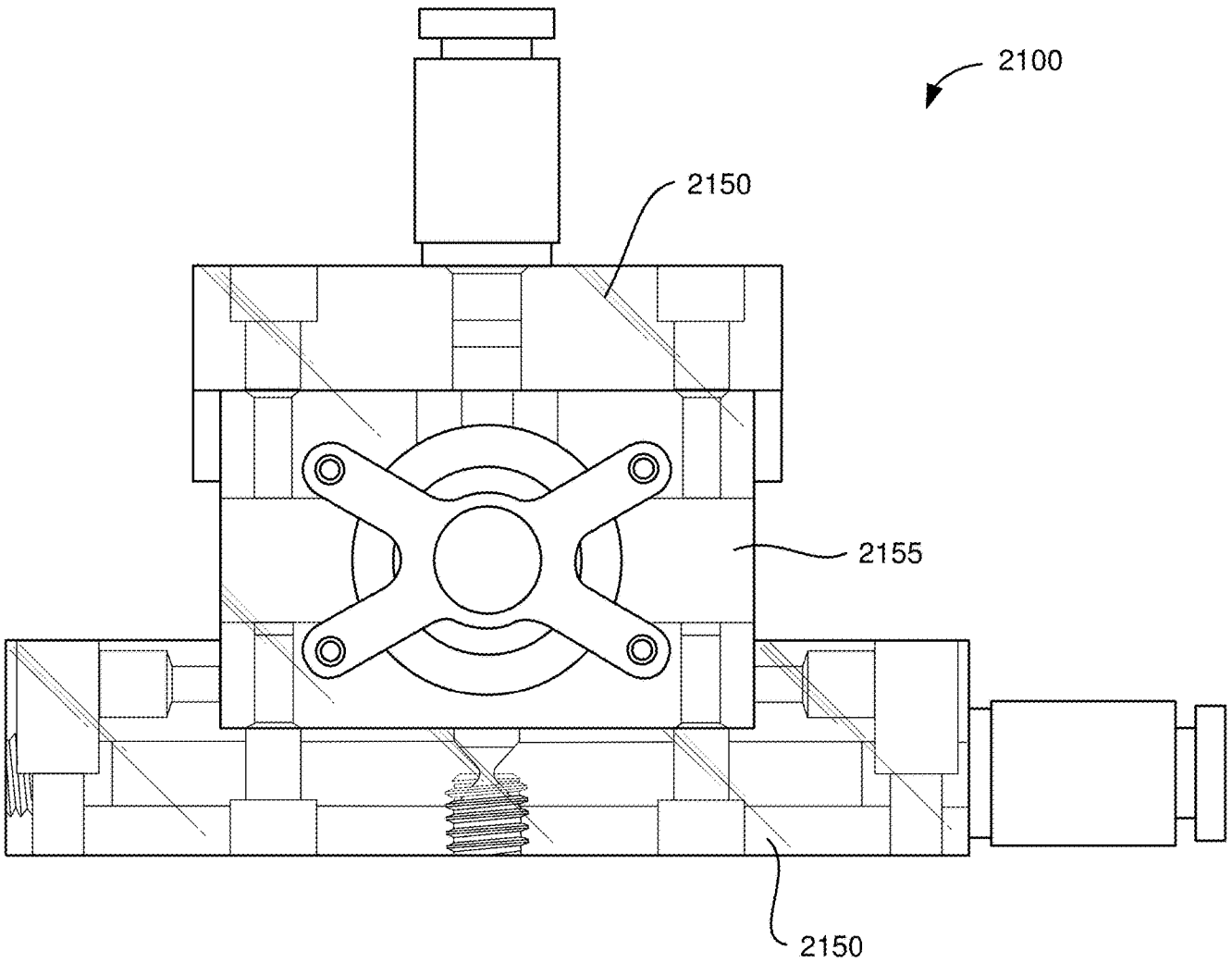

FIGS. 21A-21E show examples of schematic illustrations of a plasma channel device. FIG. 21A shows an example of an exploded view of the plasma channel device. FIG. 21B shows an example of an isometric view of the plasma channel device. FIG. 21C shows an example of a view of a portion of the plasma channel device. FIG. 21D shows an example of a side view of the plasma channel device. FIG. 21E shows an example of an end view of the plasma channel device.

Some features of the plasma channel device 2100 are similar to or the same as the features of the plasma channel device 200 shown in FIGS. 2-7. As shown in FIGS. 21A-21E, the plasma channel device 2100 includes a tube or cylinder 2105 defining a channel or a capillary 2110, a jacket 2115, jacket end-pieces 2117, a device frame 2150, and device end-pieces 2155.

The cylinder 2105 further defines a first gas port 2107 and a second gas port 2019. The first gas port 2107 and the second gas port 2109 are in fluid communication with the channel 2110. In some embodiments, the device 2100 includes a gas system (not shown) connected to the first gas port 2107 and the second gas port 2109, wherein the gas system is operable to inject a gas into the channel 2110. In some embodiments, the gas system is connected to the top openings of the first gas port 2107 and the second gas port 2019. In some embodiments, a first pressure gauge is connected to the bottom opening the first gas port 2017 and a second pressure gauge is connected to the bottom opening the second gas port 2109. From the pressure readings at the first gas port 2107 and the second gas port 2019, a density of gas in the channel 2110 can be determined. In some embodiments, the first gas port 2107 and the second gas port 2109 are each about 2 mm to 15 mm, or about 6 mm, from the ends to the cylinder 2105.

The jacket 2115 surrounds the circumference of the cylinder 2105. In some embodiments, the jacket 2115 comprises an acrylic material. A first end of the jacket 2115 defines a first cooling port 2120 and a second end of the jacket defines a second cooling port 2125. The first cooling port 2120 and the second cooling port 2125 are in fluid communication with a volume defined by the cylinder 2105 and the jacket 2115. That is, an exterior of the cylinder 2105 and an interior of the jacket 2115 define a volume. A cooling fluid (e.g., liquid nitrogen, liquid helium) can be flowed into the first cooling port 2120, through the volume, and out the second cooling port 2125 to cool the cylinder 2105 and the channel 2110 defined by the cylinder. In some embodiments, a distance between the exterior of the cylinder 2105 and the interior of the jacket 2115 that defines the volume for the flow of a cooling fluid is about 1/32 inch to 3/32 inch, or about 1/16 inch.

In some embodiments, the portions of the jacket 2115 and the cylinder 2105 defining the volume does not include the first gas port 2107 and the second gas port 2109. Having the first gas port 2107 and the second gas port 2109 offset from the volume defined by and used for cooling the cylinder 2105 can aid in preventing gas from freezing in the first gas port 2107 and the second gas port 2109.

In some embodiments, the cylinder 2105 comprises a glass. In some embodiments, the cylinder 2105 comprises sapphire. In some embodiments, the cylinder 2105 comprises quartz. In some embodiments, a first half of a cylinder with a cross-section of a half circle and a second half of a cylinder with a cross-section of a half circle can be bonded together to form the cylinder 2105. In such an embodiment, a flat surface of each half of the cylinder is defined along an axis through a center of a cylinder. On the flat surface of each half of the cylinder, the features defining the channel and the gas ports can be machined. In some embodiments, the first half and the second half of the cylinder are joined together with an adhesive, such as an epoxy. In some embodiments, the first half and the second half of the cylinder are joined together with pressure.

In some embodiments, the cylinder 2105 (and the channel 2110 defined in the cylinder) is about 6 cm to 40 cm long, about 6 cm to 20 cm long, about 12 cm long, or about 9 cm long. In some embodiments, a diameter of the cylinder 2105 is about 3/16 inch to 5/16 inch, or about ¼ inch. In some embodiments, a diameter of the channel 2110 defined in the cylinder is about 0.5 mm to 1 mm, or about 0.8 mm to 1 mm. In some embodiments, the channel 2110 is a cylinder or a right circular cylinder.

In some embodiments, the plasma channel device 2100 includes a first electrode assembly proximate the first open end of the channel 2110 and a second electrode assembly proximate the second open end of the channel 2110. Each electrode assembly includes an electrode 2130. The electrodes 2130 each define an electrode aperture 2135. In some embodiments, the electrodes 2130 comprise a metal (e.g., stainless steel). In some embodiments, the electrodes 2130 are not in contact with the cylinder 2105. For example, in some embodiments, the electrodes 2130 are positioned about 0.1 mm to 1.5 mm from the cylinder 2105. In some embodiments, the plasma channel device 2100 includes a power source (not shown) connected to the first and second electrodes 2130.

In some embodiments, the plasma channel device 2100 further includes insulators 2140 disposed between the cylinder 2105 and the electrodes 2130. In some embodiments, the insulators 2140 define insulator apertures 2145. In some embodiments, the insulators 2140 comprise a ceramic. The insulators 2140 can help to prevent arcing to other metal parts of or surrounding the plasma channel device 2100 when a voltage is applied across the electrodes 2130. In some embodiments, the electrodes 2130 are not in contact with the insulators 2140. In some embodiments, the electrodes 2130 are in contact with the insulators 2140. In some embodiments, the electrodes 2130 are heated. For example, in some embodiments, heaters (not shown) are in contact with the electrodes 2130. In some embodiments, the electrodes 2130 are heated with a laser.

Figure 10:
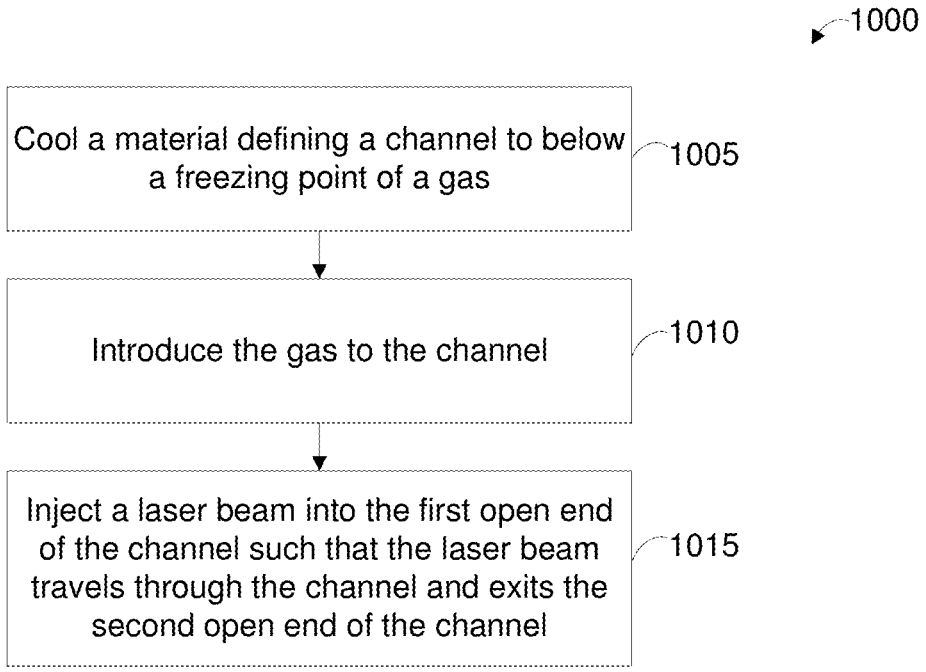
FIG. 10 shows an example of a flow diagram illustrating a process for laser plasma acceleration.

FIG. 10 shows an example of a flow diagram illustrating a process for laser plasma acceleration. The method 1000 shown in can be performed with embodiments of the plasma channel device described herein. Starting at block 1005 of the method 1000 shown in FIG. 10, a material defining a channel is cooled to below a freezing point of a gas. At block 1010, a gas is introduced to the channel. The gas freezes on the material defining the channel. In some embodiments, the channel has a cylindrical shape with a first open end and a second open end. In some embodiments, an axis of the channel lies along a straight line. In some embodiments, the material defining the channel is cooled using liquid nitrogen or a liquid helium-cooled cryostat. After the gas freezes on the material defining the channel, the channel may be considered to be defined by the frozen gas. This embodiment is considered to be a hollow plasma channel when the frozen gas is heated and ionized to a plasma by a laser pulse or a discharge pulse. Before the frozen gas is ionized to a plasma, the channel is a solid hollow channel.

In some embodiments, the gas comprises nitrous oxide ($N_2O$) or carbon dioxide ($CO_2$). For example, when nitrous oxide ($N_2O$) is used, the channel is cooled to about −155° C. or lower. When carbon dioxide ($CO_2$) is used, the channel is cooled to about −50° C. or lower. The temperature at which a specific gas freezes is also dependent on the pressure of the gas in the channel. In some embodiments, the temperature of the channel can be specified by balancing the cooling and the heating of materials or metals in contact with the material defining the channel.

In some embodiments, block 1010 is performed by introducing or flowing the gas through a first gas port and a second gas port in the material defining the channel. The first gas port and the second gas port are in fluid communication with channel. In some embodiments, the pressure of the gas from a gas system or gas source is about 0.1 pounds per square inch (psi) to 150 psi, or about 10 psi. In some embodiments, the gas is introduced to the channel over a time of about 0.1 milliseconds to 1 minute, or about 1 second to 2 seconds.

In some embodiments, a thickness of the gas frozen on the material defining the channel is uniform about a circumference of the channel. In some embodiments, a thickness of the gas frozen on the material defining the channel is about 10 microns to 500 microns. In general, the larger the diameter of the channel, the larger the thickness of the gas frozen on the material defining the channel. The time period of the gas flow, the temperature of the material defining the channel, and the pressure of the gas flow determine the thickness of the gas frozen on the material defining the channel.

In some embodiments, a thickness of the gas frozen on the material defining the channel is uniform along the axis of the channel. In some embodiments, a thickness of the frozen gas increases from zero at the first open end of the channel (e.g., an entrance of the channel) to a specified thickness, remains at the specified thickness along a portion of the channel, and then decreases from the specific thickness to zero at the second open end of the channel (e.g., an exit of the channel).

Different techniques can be used to obtain a uniform layer of gas frozen on the material defining the channel. In some embodiments, valves to the gas system connected to the first gas port and the second gas port are opened for a period of time, closed, and then the gas lines connecting the first gas port and the second gas port are pumped with vacuum pump to remove residual gas. In some embodiments, the longitudinal temperature distribution of the material defining the channel can be specified to specify or to better specify where the gas freezes to the channel wall.

In some embodiments, after block 1010, a second gas is introduced or flowed to the channel. In some embodiments, the gas introduced to the channel at block 1010 is different than the second gas introduced to the channel. In some embodiments, the second gas remains in a gaseous state in the channel. In some embodiments, the pressure of the second gas in the channel is about 5 torr to 30 torr in the channel. In some embodiments, the second gas is selected from a group consisting of hydrogen, helium, nitrogen, argon, a mixture of nitrogen and hydrogen, and a mixture of nitrogen and helium. After the gas is ionized, this embodiment is considered a near-hollow plasma channel.

In some embodiments, after block 1010, with the channel including or not including the second gas, at block 115 a laser beam is injected into the first open end of the channel such that the laser beam travels through the channel and exits the second open end of the channel. In some embodiments, the laser beam is centered in the channel. In some embodiments, the laser beam has a diameter of about 10 microns to 100 microns, or about 80 microns. In some embodiments, a wavelength of the laser beam is about 800 microns. In some embodiments, the energy of the laser beam is about 1 nanojoule to 10 joules. The laser beam may be a pulse of a laser beam or a continuous laser beam. In some embodiments, the laser beam ionizes the gas frozen on the material defining the channel.

In some embodiments, the plasma channel device used to perform the method 1000 shown in FIG. 10 includes a first electrode defining a first electrode aperture and a second electrode defining a second electrode aperture. The first electrode is proximate the first open end of the channel and the second electrode is proximate the second open end of the channel.

In some embodiments, the method 1000 further comprises applying a voltage to the first electrode while the second electrode is held at ground to ionize at least some of the gas frozen on the material defining the channel. In some embodiments, a voltage of about 10 kV to 50 kV is applied to the first electrode. Then, a laser beam is injected into the first open end of the channel such that the laser beam travels through the channel and exits the second open end of the channel. In some embodiments, the voltage applied to the first electrode is timed with the laser beam. In some embodiments, about 100 nanosecond (ns) to 600 ns, or about 500 ns, after a voltage is applied to the first electrode, at block 1015 the laser beam is injected into the first open end of the channel.

In some embodiments, after block 1010, after the second gas is introduced to the channel, a voltage is applied to the first electrode while the second electrode is held at ground to ionize the second gas. At block 1015, a laser beam is injected into the first open end of the channel such that the laser beam travels through the channel and exits the second open end of the channel.

The following examples are intended to be examples of the embodiments disclosed herein, and are not intended to be limiting.

Example 1—Introduction

With a high-quality injector, particle beams with low energy spread, emittance and divergence can be produced. If these beams are injected into a second LPA stage for further acceleration, that stage must also maintain beam quality. For a particle accelerator with many stages, high luminosity at the collision point places stringent requirements on each individual stage. Using techniques such as density down-ramp injection and two-color ionization injection, laser plasma accelerators can produce beams with a small initial emittance on the order of those produced in a conventional RF accelerator. A challenge is to maintain this emittance during acceleration.

When a beam with a nonzero energy spread accelerates, if the beam size is mismatched to the plasma focusing forces, the emittance can increase by orders of magnitude as a result of betatron decoherence. The matched spot size $\sigma$ is defined as:

$$\sigma = \frac{\epsilon_n}{\gamma\sqrt{K}},$$

where $K=k_p^2/(2\gamma)$ is the strength of the plasma focusing force. For higher beam energies, weaker focusing is required to satisfy the matching condition and prevent emittance degradation. As a laser pulse propagates through a homogenous or parabolic plasma channel, the transverse electric fields in the plasma wake depend on the gradient of the laser intensity profile, and tailoring the laser's profile can reduce the focusing force. For example, with a flat-top pulse $a^2=a_0^2$, the transverse ponderomotive force becomes $F_{p,\perp}\propto\nabla_\perp a^2=0$. Simulations have shown that higher order laser modes can also shape the transverse profile of the laser, allowing for control over and reduction of the focusing fields. Without a tailored pulse, depending on the laser and plasma parameters, the magnitude of the focusing force, while zero on-axis, can be on the same order as the accelerating force off-axis. These large fields place stringent requirements on the beam spot size, especially at higher energies.

In addition, as a particle beam accelerates in a homogeneous or parabolic plasma channel, the beam Coulomb scatters off background ions, inducing emittance degradation as the beam propagates. A large focusing force can compensate for the emittance growth due to scattering, but it then contributes to emittance growth through beam mismatch. Hollow and near-hollow plasma channels were proposed as a new technique to guide a laser pulse while providing favorable accelerating and focusing fields for both electrons and positrons. A near-hollow plasma channel with radius rw has a density profile of the form:

$$n(r) = \begin{cases} n_{ch} & \text{for } r < r_w \\ n_w & \text{for } r \geq r_w \end{cases}$$

where $n_{ch} \ll n_w$, When $n_{ch}=0$, the channel is hollow. As a laser propagates through this structure, it both drives a plasma wake inside the channel when $n_{ch}$ is non-zero and surface currents in the wall which induce fields that extend into the channel. The accelerating field is transversely uniform and dominated by the plasma density in the wall $n_w$, while the focusing field is linear and dominated by the plasma density in the channel $n_{ch}$. Independent control over the transverse and longitudinal electric fields allow the wakefield to be matched to the particle beam during acceleration while maintaining a high acceleration gradient. Large acceleration gradients with weak focusing forces for emittance preservation can be achieved. The reduced density on axis in the channel also mitigates the emittance growth due to Coulomb scattering.

Hollow plasma channels have been theoretically investigated for decades, but this technique has not been extensively investigated experimentally because of the difficulties in producing the required density profile. In the few experiments performed, the channel was generated by hollow Bessel beams using phase masks and special conical lenses called axicons. The off-axis region of the laser had enough intensity to ionize neutral gas, but the center of the pulse did not, generating a hollow plasma channel as it propagated. Experiments demonstrating the formation of these structures have shown that wakefields can be excited in the channel by a positron beam. This method, however, does not allow for independent adjustment of the wall and channel density. In addition, the channel has neutral atoms on-axis which will contribute to emittance degradation and limit the current of the beam propagating through the channel so as not to ionize the gas.

Below, we describe the development of a cryogenically formed, variable radius waveguide whose flexibility allows it to be applicable to various laser guiding and acceleration regimes, including as a hollow plasma channel. These waveguides were formed by flowing a gas with freezing temperature $T_f$ through a capillary which was cooled down to a temperature less than $T_f$. As the gas propagated through the capillary, it froze to the walls and formed an ice shell. Shell thicknesses on the order of 100 μm were grown within a few seconds. A second species of gas with a freezing temperature lower than $T_f$ was introduced into the capillary to add density on-axis. A discharge pulse ionized the ice shell and gas, and guiding of a low-power laser through the plasma channel was demonstrated.

Example 2—Capillary Design and Ice Growth

Figure 11:
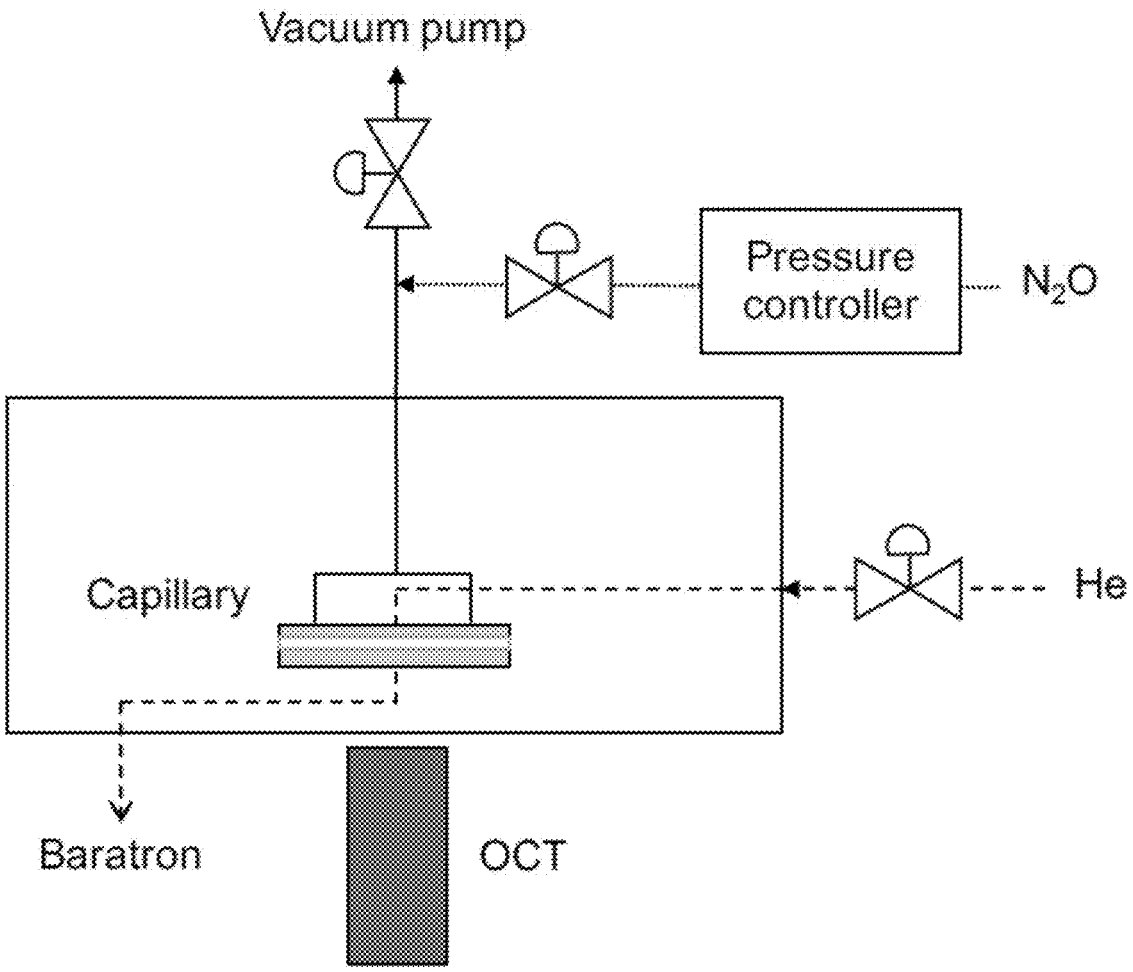
FIG. 11 shows an example of a schematic illustration of the optical coherence tomography (OCT) and capillary set-up including the valves and pressure controllers for regulating the gas flow and a baratron for measuring the pressure inside the channel.

In the designs tested, the capillary was cooled by liquid nitrogen which has a temperature of 77 K. The gas to be frozen was nitrous oxide $N_2O$ which is relatively inexpensive, safe, and freezes at a temperature above 77 K for a wide range of pressures. FIG. 11 shows a schematic of the capillary and optical coherence tomography (OCT) set-up. Because the effective focal length of the OCT lens was 36 mm and the OCT scanning system could not be installed in vacuum, the capillary was mounted inside a vacuum chamber a millimeter away from a window with the OCT directly on the other side.

A pressure controller regulated the nitrous oxide pressure inside the capillary. As various designs were tested, a valve for better control over the $N_2O$ gas flow was added as well as a valve connected to a vacuum pump for evacuating the capillary of residual gas. Eventually a helium line was added to facilitate discharge and a baratron to measure the pressure inside the capillary.

Aluminum and Acrylic Capillaries. To determine whether the nitrous oxide would freeze to the walls of a capillary, a simplified model was first tested. This version was a 9 cm long aluminum block with a 3 mm diameter channel machined down the center surrounded by two 3 mm diameter channels for liquid nitrogen flow. 40 Torr of nitrous oxide was continuously flowed through two gas slots into the channel as the aluminum block was cooled. Over the entire freezing process until the channel froze shut, the ice shell was radially uniform.

The channel radius during deposition was measured. The gas started freezing to the channel wall at time t=0, and the ice shell thickness grew at a rate of 122 μm/s. After 1 minute, the gas flow was stopped. The channel radius remained constant and did not melt. After 3.6 minutes, the flow was initiated again, and the ice continued to deposit until the channel froze shut.

With the capillary made of aluminum, the longitudinal growth of the ice could not be observed, and so an acrylic version was made with the same dimensions. For ice growth in the acrylic capillary, it was seen that the shell thickness was no longer radially uniform. Simulations of the temperature distribution over time in both the acrylic and aluminum capillaries were performed using the commercially available finite element software. The capillary was modeled with a constant 77 K boundary condition on the liquid nitrogen lines. Transient thermal analysis was performed over a period of 20 s for both capillaries. At the end of the simulations, the temperature in the aluminum capillary varied by less than 2 K around the main channel. From the temperature distribution in the acrylic capillary after the same period of time, it was seen that the temperature around the main channel varies from 100 K to 230 K and that the region of the channel closer to the liquid nitrogen lines reached a lower temperature.

A lower wall temperature will cause ice to deposit faster. Therefore, where the capillary is closer to the liquid nitrogen, a thicker ice layer develops. Aluminum has a thermal conductivity of 205 W/(m·K) while acrylic has a thermal conductivity of 0.2 W/(m·K). Because of the acrylic's lower thermal conductivity, the cooling distribution becomes more important. Successive capillaries were made with either radially symmetric cooling or from materials with high thermal conductivity.

A second acrylic capillary with four liquid nitrogen lines machined at the far corners of the block was tested. This configuration provided a more uniform temperature distribution around the central channel and resulted in radially uniform ice growth. To isolate the gas slots and prevent gas from freezing before it reached the channel, the slots were thermally separated from the rest of the capillary. The capillary was cooled to 108 K and 120 psi of gas was continuously flowed through the channel.

The longitudinal ice deposition after 86 s of growth was measured. It was seen that the ice thickness increases in the flow direction until a plug forms. Since thicker ice layers grow faster, the plugs dominate the longitudinal ice growth. As nitrous oxide molecules freeze at the entrance of the cap and at the plug, the gas density decreases with propagation and regions further from the entrance do not experience as much growth.

Once the plugs started to develop, no appreciable ice deposition occurred further into the channel. The plugs were the result of a wall temperature (108 K) much lower than the freezing temperature of the gas (approximately 193 K) as well as reduced gas flow. Because the wall temperature was low, the gas bulk temperature decreased quickly and ice deposited close to the entrance of the channel. In addition, the gas entered through both gas slots and filled the capillary, forming a stagnant channel of gas after a few hundred μs. By this time, no appreciable ice layer had formed, but the flow rate had decreased as a result of the reduced pressure drop between the channel entrance and center. As the flow velocity decreases, the amount of heat that can be transferred to a volume of gas increases, and the gas freezes faster. Both of these effects contributed to the plugs growing at the entrance, preventing ice formation further into the capillary.

Attempts to prevent the plugs from forming were made by locally heating the ends of the channel using resistive heaters placed on top of the channel near the plug location. However, because the wall was thick, the heat spread over a wider distance than desired and resulted in no ice growth over an extended region. For finer temperature control, the channel was then made out of a glass tube.

Figure 22:
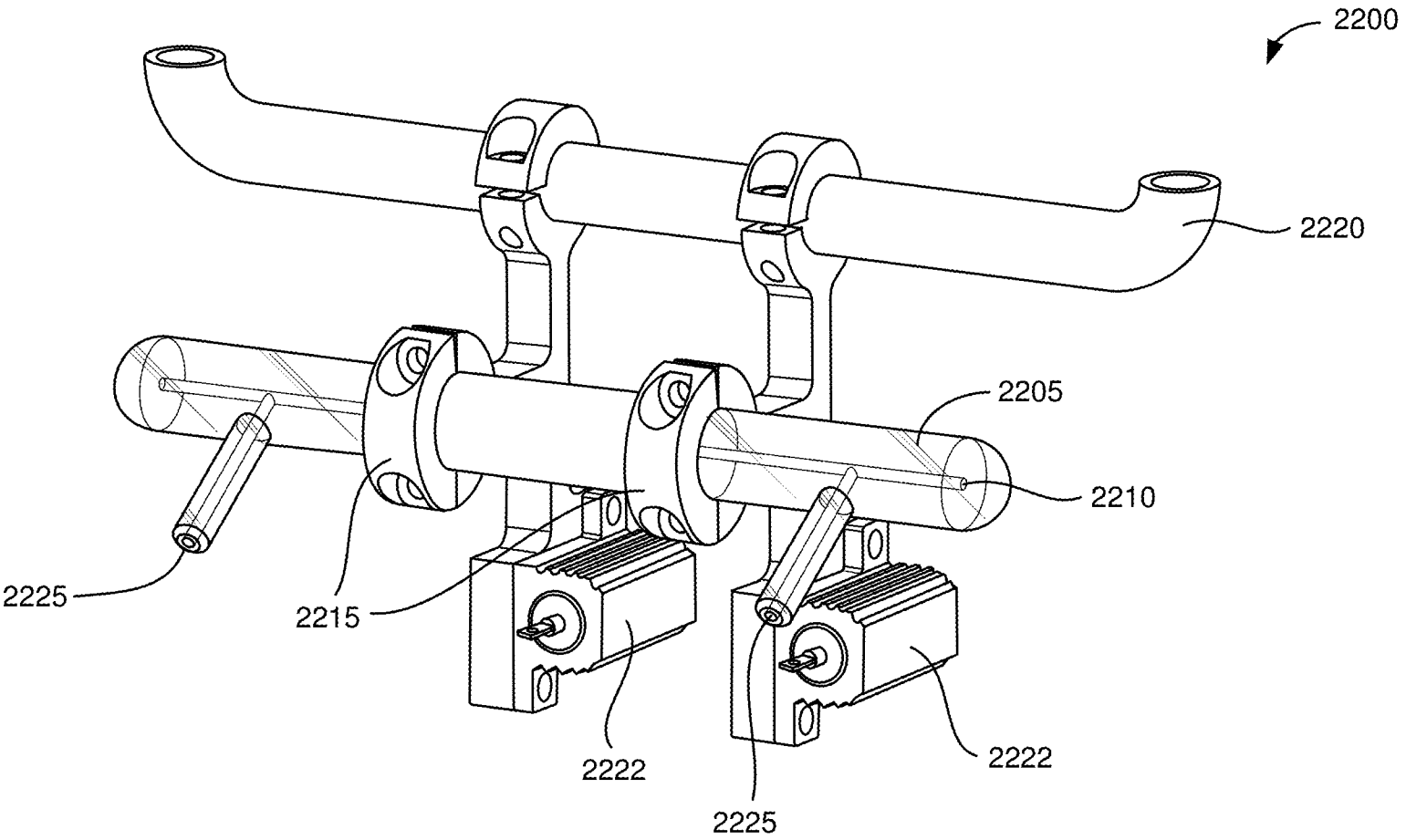
FIG. 22 shows an example of a schematic illustration of a device including a glass tube.

Glass Capillaries. To ensure symmetric cooling, the capillary was made using a 9 cm-long quartz tube with a 1.5 mm inner diameter and 7.5 mm outer diameter. Quartz was chosen over other types of transparent materials such as borosilicate glass because of its lower coefficient of thermal expansion, making the capillary more resistant to changes in temperature. $N_2O$ gas of varying pressure flowed into the capillary through two glass tubes of 2 mm inner diameter fused to the central channel. For most of the tests, the glass capillary ends were closed while the pressure was varied to protect the chamber vacuum pumps. FIG. 22 shows an example of a schematic illustration of a device 2200 used in these experiments.

The device 2200 shown in FIG. 22 includes a quartz tube 2205 defining a capillary 2210, cooling rings 2215 in contact with the glass tube 2205, a cooling tube 2220 in thermal contact with the cooling rings 2215, and heating elements 2222 in thermal contact with the cooling rings 2215. Gas ports 2225 in the sides of the glass tube 2205 allow for the flow of gas into the capillary 2210.

The temperature of the glass tube was controlled using the cooling ring. The rings are machined from oxygen free, high thermal conductivity (OFHT) copper. One end of the cooling ring is clamped to a copper liquid nitrogen tube, and a resistive heater is attached to the other end. The entire copper ring was then clamped around the glass tube. To provide longitudinally uniform cooling, a thin jacket of OFHT copper was placed around the glass tube such that the cooling ring clamped the jacket to the glass. The jacket had a slit through which the ice could be observed. A thermocouple attached to the copper ring measured the temperature, and the liquid nitrogen cooled the capillary at a rate of 1 K/s. By adjusting the resistive heater voltage, the temperature at the glass tube could be controlled.

The temperature distribution of the cooling ring with 24 W of heating power was calculated. At this power, the temperature is a constant 83 K along the ring clamped to the glass, providing radially symmetric cooling. The intent was to add a series of cooling clamps along the length of the channel and control the temperature of each independently, providing a more complicated longitudinal temperature distribution if desired. For improved thermal contact, a layer of indium was added between the glass and the copper jacket.

Figure 12:
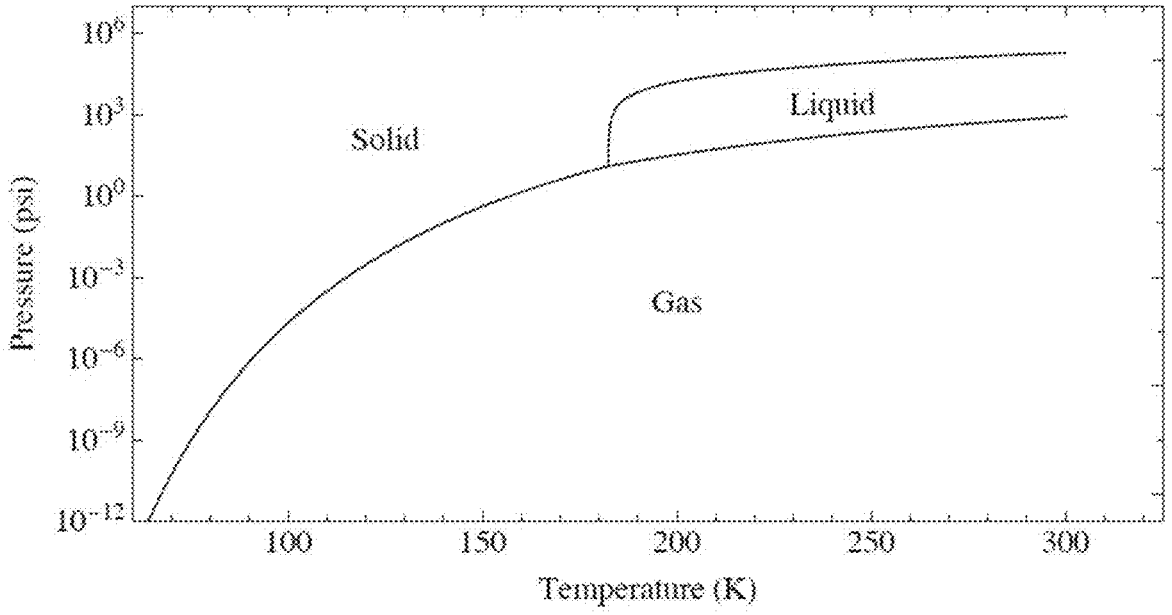
FIG. 12 shows an example of the phase diagram of nitrous oxide.

Different techniques for depositing ice onto the capillary walls were tried. One option is to first fill the channel with nitrous oxide at pressure p and then decrease the wall temperature. When the temperature reaches the freezing temperature, $N_2O$ deposits onto the wall. The relationship between the nitrous oxide pressure and freezing temperature is shown in FIG. 12. The temperature $T_t$ and pressure $p_t$ at which all three phases co-exist in thermal equilibrium, called the triple point, is 12.7 psi and 182.3 K, respectively.

If $p>p_t$, the gas will first liquify as it cools. Condensation begins at the location of the cooling rings as these points reach the condensation temperature first. In these tests, a clearly defined liquid front was observed. Once the freezing temperature was reached, the liquid rapidly froze. Without more sophisticated temperature regulation enabling the liquid to slowly freeze, this process was non-reproducible and difficult to control. Uniform, reproducible ice layers were never measured. Therefore, the technique of filling the channel with gas and then decreasing the wall temperature was considered unsuitable for this application given the temperature control available.

If the pressure is lower than the critical pressure $p_t$, then the gas can transition to a solid without passing through the liquid phase. However, using the solid density of nitrous oxide, this pressure corresponds to an ice thickness layer of a few microns, too thin for many applications.

Instead, the channel wall temperature was first decreased to a temperature below the $N_2O$ freezing temperature, and then nitrous oxide was added into the channel at the desired pressure. A fast-response valve after the pressure controller further regulated how much gas flowed through the channel by changing the time the valve was held open.

In the first set of experiments, the capillary was cooled until the temperature started to level off around 108 K, and then gas was added into the channel through both gas slots. With the cooling rings, radially symmetric ice growth was observed, and the longitudinal ice deposition was then addressed. The OCT system was installed during the glass capillary experiments, and more precise measurements of the ice growth could be taken. Two-dimensional OCT images of ice deposition along a section of the capillary, measured at the channel centerline, were recorded. The glass and ice interface locations are clearly defined. For each longitudinal position, a lineout was taken and peaks in the intensity were identified as the glass and ice interfaces. The ice thickness layer is defined as the difference in these two positions. Only the two interfaces can be seen in the OCT image, showing no substructure when the ice freezes.

The ice growth as a function of time for a 7.5 mm length section of capillary starting at the gas slot was measured. The $N_2O$ valve was open for only 500 ms, but it was seen that the gas thickness continued to increase at the end of the channel for longer than 1 minute. Because the wall temperature was much lower than the freezing temperature of the $N_2O$, the gas froze rapidly as soon as it hit glass, which occurred inside the gas slots. As ice continued to deposit, plugs developed inside the slots, resulting in thicker ice layers near the ends. However, as the OCT images showed, a uniform ice layer approximately 100 μm thick was deposited at early times.

To prevent the gas at later arrival times from depositing at the ends, the channel was evacuated after the first initial deposition of ice. The gas valve, while controlling the amount of gas entering the capillary, did not effectively control the duration of the gas pulse. As the valve opened, gas expanded into the tubing leading to the capillary, causing the gas to spread out and resulting in a longer pulse duration than the gas valve opening time. A second valve connected to a vacuum pump enabled better control over the pulse duration.

The time between the closing of the gas valve and opening of the vacuum valve determined the effective deposition time: the shorter the time between the valves, the shorter the deposition time. Because gas arriving at later times preferentially deposited at the ends of the capillary, shorter gas pulses prevented plugs from developing inside the gas slots. Without the vacuum valve, the difference in thickness from the entrance of the channel and a point 12 mm inside the channel was 200 μm. Waiting 2 s before opening up the vacuum valve, decreased the difference in thickness to 60 μm. Waiting 1 s or less resulted in longitudinally uniform ice growth. In subsequent experiments, the vacuum valve was opened immediately after the gas valve closed.

Like the second acrylic capillary, however, no appreciable ice layer was detected between the two gas slots. The ice would freeze up to 15 mm into the channel and then the thickness would rapidly decrease to nothing over a couple centimeters. This effect was attributed to the lack of flow rate during most of the freezing process and the buildup of ice in the gas slots and channel entrance. To prevent non-uniform ice deposition, gas flow needs to be maintained. Instead of having gas enter through both gas slots, gas was flowed into the channel through one slot and the second gas slot was left open into the vacuum. In this configuration, the gas flow rate was high. The ice thickness for 50 psi of pressure and a 0.5 s gas valve opening time along the length of the glass tube was recorded. The ice layer deposited with an average of 133 μm uniform thickness along the length of the tube.

The measured ice thickness around the copper ring was used to predict the ice underneath the ring. The left side of the capillary was partially blocked by the window mount, resulting in a slightly thicker layer due to reduced gas flow. Once the ice fully deposited, the thickness remained constant.

To deposit thicker ice layers, more gas was flowed through the channel. One technique investigated using the glass capillary was to send in another burst of $N_2O$. Once the first layer had deposited, opening the gas valve a second time added more gas into the capillary which froze to the existing ice shell and increased the layer thickness.

In general, the ice thickness can also be controlled by the pressure, but when the flow rate is high, the thickness is very weakly dependent on the gas density. The average thickness of the ice shell as a function of $N_2O$ pressure for a 0.5 s valve opening time was measured. Over the length of the capillary, the thickness was uniform. The measured ice thickness fluctuated due to the rough surface. It was seen that over a large pressure range (1 psi to 100 psi), the thickness is weakly dependent on pressure. The glass capillary design demonstrated longitudinally uniform ice growth for a range of ice thicknesses. However, in other experiments investigating guiding in a gas-filled discharge capillary where the capillary was made out of glass, the glass shattered after a few shots of high intensity laser pulses. For this reason, studies of ice shells in glass capillaries were suspended, and capillaries made out of sapphire were investigated.

Sapphire Capillaries. Because sapphire has a high thermal conductivity (k=23.1 W/mK), it can be cooled efficiently. Sapphire capillaries have also already been shown to survive discharge and high-intensity laser pulses. The channel is laser machined into two 6 cm sapphire blocks which are then glued together to form a 1 mm diameter channel with an approximately circular cross-section. Two gas slots of 1 mm diameter were machined perpendicular to the main channel, 6 mm from the end. Nitrous oxide and helium gas flowed into the channel through these slots. A third gas slot was machined in the center of the channel but was kept plugged during these experiments. At the output of one of the gas slots, a baratron was added to measure the pressure inside the capillary.

A thermocouple attached to the outside of the sapphire wall measured the capillary temperature. Liquid nitrogen cooled the capillary with a cooling rate of 1.5 K/s. To provide a level of temperature control with enough heating to raise the capillary temperature from 77 to 153 K, the freezing temperature of $N_2O$ at 10 psi, two 24 W ceramic resistive heaters were clamped to two liquid nitrogen copper tubes. Each resistive heater plus liquid nitrogen tube assembly was clamped to two thin plates of copper. The plates bracketed the top and bottom of the sapphire blocks to provide uniform cooling along almost the entire length of the capillary. For temperature control, the resistive heater voltage could be adjusted.

The sapphire plates and copper cooling assembly were both mounted in an acrylic holder. As will be further detailed later, discharge and plasma channel formation were tested in the sapphire capillary. Therefore, a ceramic disk was glued at each end of the capillary to prevent the discharge from arcing to places other than down the channel. Two stainless steel electrodes were positioned inside the ceramic disk to provide the electric potential. The electrodes were mounted separately from the rest of the capillary.

With gas flowing through both gas slots, the capillary quickly reached a stagnant pressure. As was demonstrated with the acrylic and glass capillaries, reduced gas flow with a wall temperature much lower than the freezing temperature of $N_2O$ resulted in non-uniform longitudinal ice growth. In most cases, the ice never reached the center of the channel. More uniform layers were demonstrated by increasing the gas flow. The deposition rate as a function of position along the channel is also dependent on the wall temperature. This relationship was investigated using the sapphire capillary.

The capillary was cooled first, and gas was added into the channel at a given pressure and duration once the desired temperature had been reached. The ice thickness along the length of the capillary was measured for wall temperatures of 143 K and 153 K at 25 psi pressure and 500 ms gas valve opening time. It was seen that the longitudinal distribution is dependent on the capillary wall temperature. For lower wall temperatures, the ice thickness at any point grows at a much faster rate, leading to non-uniform longitudinal growth. Because the gas begins to freeze inside the gas slots, the ice thickness is largest where the slots meet the main channel (at 4 mm and 50 mm). To maintain a constant ice thickness along the length of the capillary, the wall temperature should be close to the freezing temperature. This temperature was determined by experimentally measuring the temperature at which ice would just start to deposit: at a warmer temperature there would be no ice growth, and at a colder temperature non-uniformity would start to develop.

Once the optimal wall temperature was determined, the ice thickness was tuned using the gas valve opening time. With more gas flowing through the capillary, more ice was deposited, leading to thicker layers. The ice layer along the length of the capillary for a 25 psi backing pressure, 153 K wall temperature, and 0.5 s and 1.5 s opening time, were measured. A 112 μm ice layer deposited when the valve was held open for 1.5 s while a 44 μm ice layer deposited when the valve was held open for 0.5 s. The ice thickness fluctuations caused by surface roughness is 8.6 μm and 7.6 μm for 1.5 s and 0.5 s opening time, respectively. The gas slots were located at 3.5 mm and 26.0 mm. Neglecting the end 5 mm where the end of the capillary distorts the ice growth, the 1.5 s (0.5 s) layer has a maximum thickness variation of 17 μm (29 μm).

The ice thickness increases uniformly across the channel with opening time. The thickness as a function of opening time ranging from 0.2 s to 2.2 s was measured. The measured thickness fluctuated as a result of the rough ice surface. For each second the gas valve remained open, 67 μm of ice deposited. After an ice layer had developed and was measured, either flowing room temperature air through the liquid nitrogen lines or increasing the voltage on the resistive heater resulted in an increase of the capillary temperature and melted the ice. Once the ice had fully melted, another ice shell could be regrown. Two ice growth cycles, both with 25 psi of pressure and a 1.5 s gas valve opening time, resulting in 107 μm and 112 μm layer thicknesses, were performed. With the same initial parameters, the ice shells are reproducible.

The ice thickness measurements were all located between the gas slots unless otherwise stated. It was observed that the ice in the region from the gas slots to the end of the channel would begin to melt away after the initial deposition. The melting would initiate at the end of the channel and slowly propagate inward over a few seconds, leaving a zone free of ice. Several effects could contribute to the ends melting. The ceramic disks at the ends of the capillary transferred heat from the capillary mount, which remained within a few degrees of room temperature during these tests, to the sapphire. In addition, the copper assembly did not extend all the way to the ends of the sapphire. Thus, the ends were the warmest part of the channel. In this design, a melt zone of 6 mm developed within a few seconds after the initial deposition. When guiding a laser pulse through the channel, entrance effects can impact the guiding properties when the Rayleigh length of the laser is on the order of this melt zone. However, for the guiding experiments, the Rayleigh length of the laser was 2.5 cm, and this edge melting was considered acceptable. Improved cooling and decreased heat transfer between the ends and the rest of the capillary can potentially improve this effect if it is needed.

Example 3—Guiding

In the cryogenically-formed capillary, various guiding mechanisms are possible.

Guiding Theory. A discharge pulse propagating through a gas-filled channel induces a dynamic waveguide, evolving to form a plasma channel with a parabolic density profile. At the beginning of the discharge pulse, the plasma temperature, density, and degree of ionization increase homogeneously. Around the time of full ionization, the plasma temperature becomes radially non-uniform as heat is transferred from the plasma to the cold capillary walls. At the peak of the discharge current, the plasma temperature and density reach a quasi-steady state with a maximum temperature (minimum density) on-axis. The radial density profile is approximately parabolic and remains so until recombination occurs.

The energy and quality of the particle beams accelerated in these channels are dependent on the channel shape and density. Various techniques including transverse and longitudinal interferometry have measured the channel profile and evolution. Here, we used the measured spot size and peak intensity of the laser pulse at the exit of the capillary. The matched spot size $w_M$ is one indicator of the channel's guiding properties and is defined as the spot size at which the channel will guide a laser pulse with a constant spot size (z) during propagation. If the laser is not matched to the channel, the laser intensity will oscillate during propagation, and the plasma wake amplitude, and thus acceleration and focusing properties, will also oscillate. High intensity laser pulses with small spot sizes on the order of tens of microns require waveguides with small matched spot sizes to maintain a constant intensity.

Discharge. Having developed reproducible and uniform ice layers of varying thicknesses, the effect of a discharge pulse on the ice layer was investigated. After the ice had fully deposited and no more growth was observed, helium gas was flowed through the capillary. The added gas caused the capillary temperature to increase: for 20 Torr pressure inside the capillary, a 6 K rise in temperature was measured before steady state was reached. If the capillary temperature was close to the freezing temperature when helium was added, the ice layer would melt. Therefore, the capillary was allowed to cool at least 6 K before adding helium.

A 20 kV pulser generated a large electric field across the electrodes situated on both ends of the capillary. Without an applied electric field, an electron must acquire a minimum amount of energy, called the work function, to escape the surface of the electrode. For most metals, the work function is on the order of a few electronvolts. The induced electric field lowers the potential barrier of the atoms on the electrode surface, and the larger the applied electric field, the more the potential barrier is suppressed, making it easier for electrons to tunnel through. If the helium gas is sufficiently dense, the electrons can collide with and ionize neutral atoms, each of which has a probability $\gamma_{se}$ of emitting a secondary electron. If each electron can ionize enough atoms and release enough secondary electrons, breakdown occurs, and a discharge pulse propagates through the channel.

The breakdown voltage $V_B$, or minimum voltage required to make the gas electrically conductive, is dependent on the type of gas, the pressure at the electrodes p, the distance between the electrodes d, and the gas temperature T as given by Paschen's law:

$$V_B = \frac{Bpd / k_B T}{\ln(Apd / k_B T) - \ln\left[\ln\left(1 + \frac{1}{\gamma_{se}}\right)\right]},$$

where $\gamma_{se}$ is the secondary-electron-emission coefficient, and A and B are constants related to the neutral gas ionization potential and cross-section. The constants A and B can be determined experimentally.

There is a limiting value of the combined pressure and electrode distance pd below which breakdown cannot occur, and at both small and large pd values the breakdown voltage is large. When pd is low, either the gas density is low or the electrodes are very close. Even when many secondary electrons are emitted, the probability that they will collide with a neutral atom before reaching the anode is low. As pd increases, the collision probability increases, and the voltage required to initiate breakdown decreases. At large values of pd, electrons undergo many collisions and cannot build up enough velocity to ionize neutral atoms. In this regime, a larger voltage is required to accelerate them, and the breakdown voltage increases with increasing pd.

Figure 13:
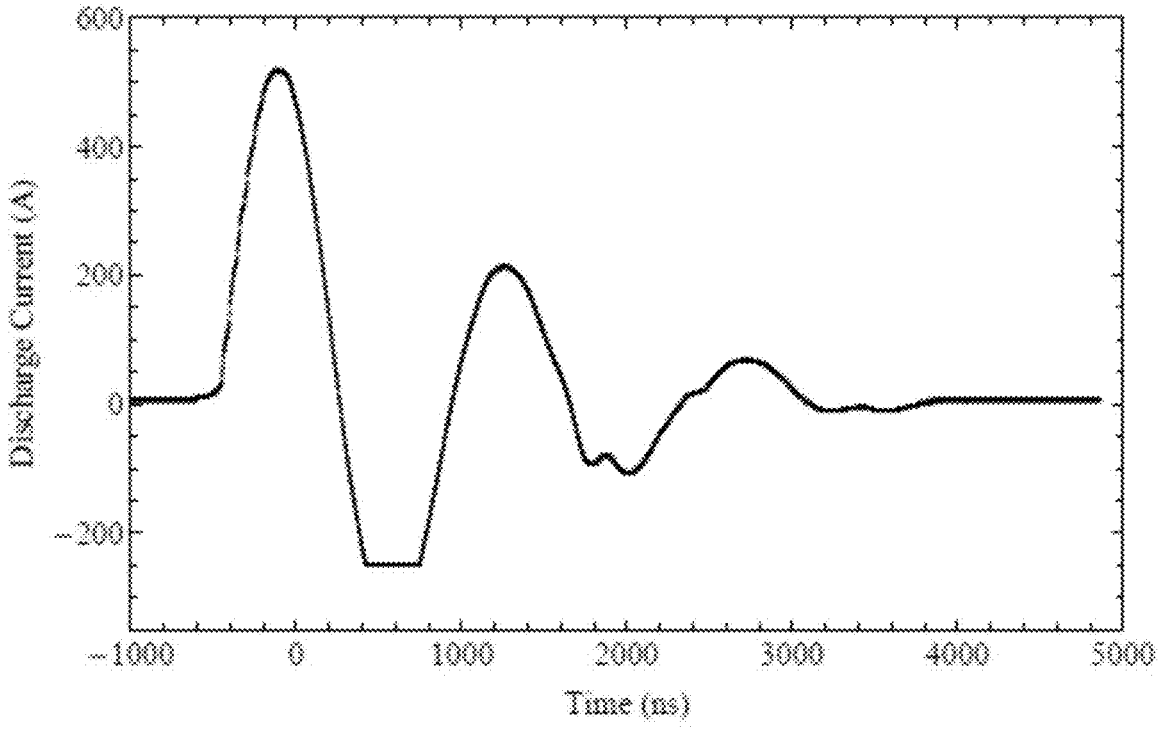
FIG. 13 shows an example of discharge current versus time for a 500 A discharge pulse.

Reducing the temperature of the electrodes decreases the likelihood of breakdown. To prevent the electrodes from getting cold, they were displaced from the ends of the capillary by approximately 0.5 mm. The gas expands as it leaves the channel, decreasing in density by an amount proportional to $1/r^3$ where r is the distance from the channel exit. Therefore, even a small displacement leads to a significantly decreased gas density at the electrodes, and it becomes harder to discharge, manifesting as fluctuations in discharge timing. To reduce these fluctuations, the electrodes should be placed as close to the ends of the capillary as possible while still not touching. The fluctuations can also be improved by increasing the capillary pressure which increases the density at the electrodes. The vacuum pumps, however, placed a 25 Torr upper limit on the capillary pressure. In the following guiding experiments, the pressure was maintained at 20 Torr, and a 500 A discharge pulse, measured by current monitors on either side of the capillary, ionized the gas. FIG. 13 shows an example discharge pulse. The best discharge timing fluctuation achieved in a cryogenically formed capillary was 350 ns. In a 1 mm warm capillary with no gap between the ends of the capillary and the electrodes, the fluctuation in timing was 37 ns.

With gas continuously flowing through the capillary at 20 Torr, the chamber pressure would rise to approximately $10^{-2}$ Torr. If any metal was placed close to the electrodes, the discharge would short to the metal rather than through the capillary. As such, special care was taken to use non-metallic components such as plastic instead of metal screws. No path was made available from the electrodes to the copper cooling clamps. However, the discharge pulse would arc to the thermocouple and damage the thermocouple reader. To protect the reader, the thermocouple was disconnected before firing the discharge. Thus, the capillary temperature and discharge could not be concurrently measured.

Figure 14:
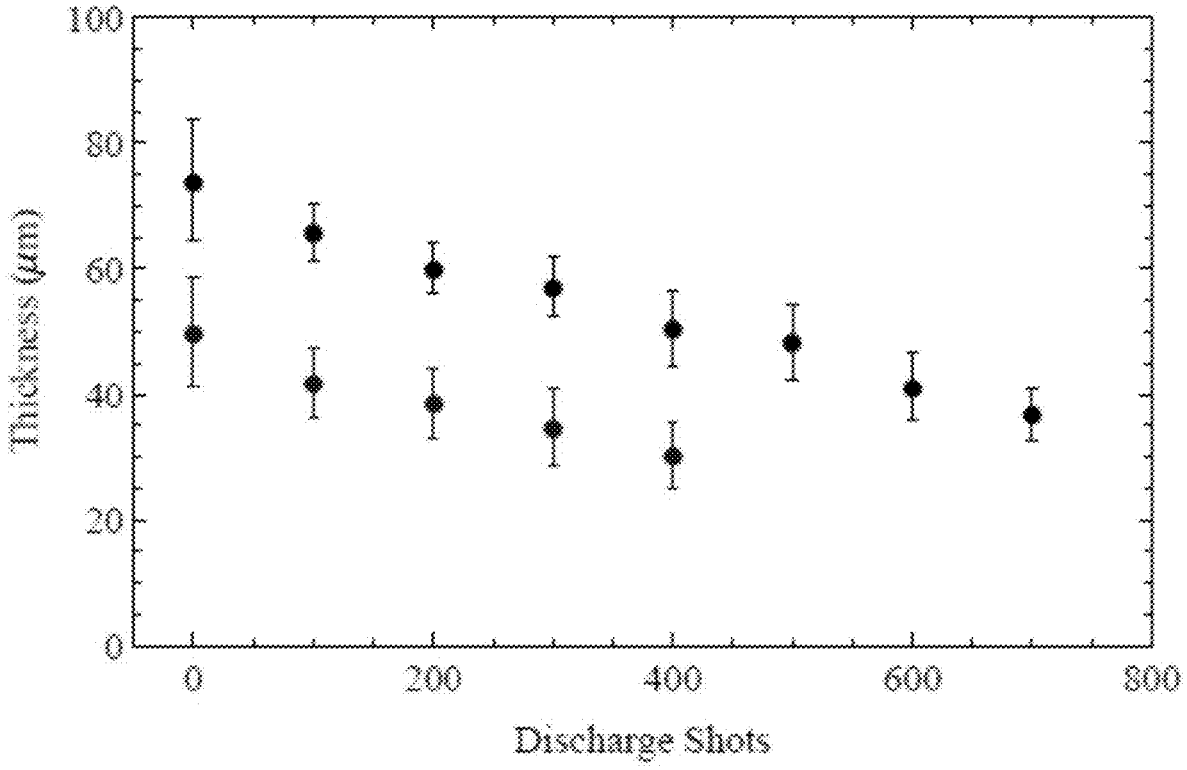
FIG. 14 shows an example of ice thickness as a function of discharge shots for an initial ice shell 74 μm thick (upper) and 50 μm thick (lower).

Each discharge shot ablated a fraction of the ice shell. To measure the amount of ice ablated per discharge shot, the thickness after every 100 shots was measured. FIG. 14 shows the ice thickness as a function of shots for an initial 74 μm and 50 μm thick ice shell. The discharge ablated the ice shell at a rate of 50.6 nm/shot and 46.6 nm/shot, respectively. After 700 shots, approximately 35 μm of ice had ablated. For a helium pressure of 20 Torr and assuming that the helium gas is at 300 K, this level of ablation corresponds to a 1.8 μm increase in matched spot size, a 2% change. Therefore, with a discharge ablation rate of tens of nanometers per shot, the ice shells can last hundreds of shots before a new layer has to be regrown.

Figure 15:
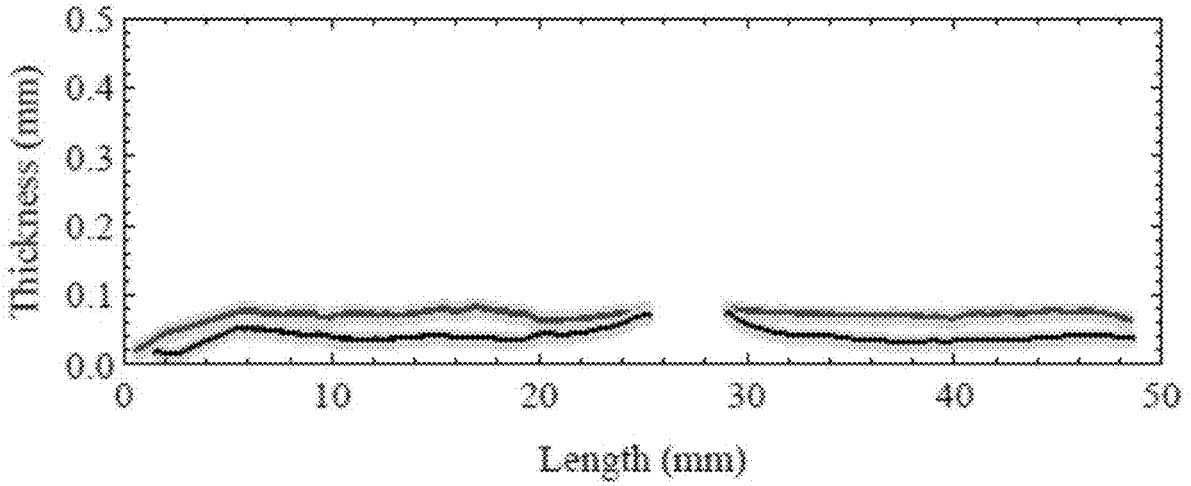
FIG. 15 shows an example of the ice thickness over the length of capillary before (upper) and after 700 discharge shots (lower). The ice free zone from 25 mm to 29 mm corresponds to the region near the center gas slot.

FIG. 15 shows the ice thickness for an initial 80 μm ice layer before and after 700 discharge shots. It was seen that the discharge ablates the ice relatively uniformly along the length of the capillary except near the center gas slot located at position 25-29 mm. As the ice ablated, it flowed up the gas slots and refroze, causing this increase in thickness.

Figure 16:
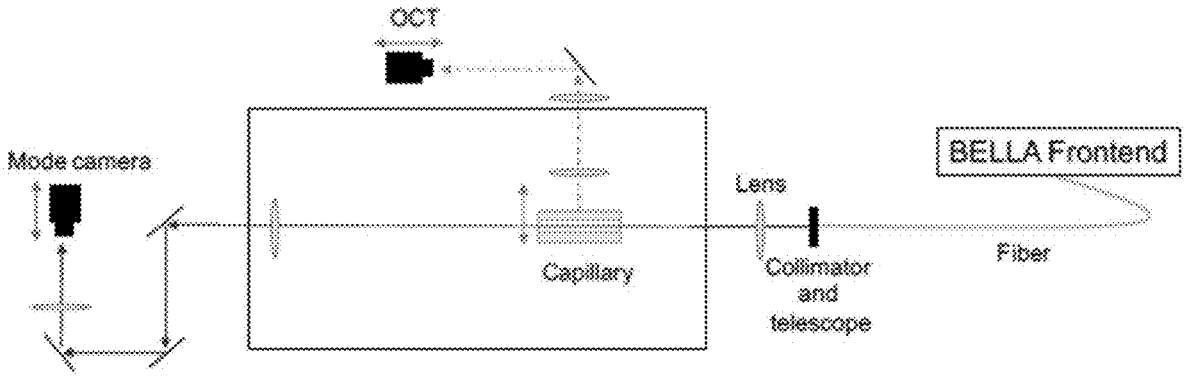
FIG. 16 shows an example of a schematic diagram of a low power laser beamline with capillary and laser diagnostics.

Experimental Set-up. To study the guiding properties of the cryogenically formed capillary, the capillary and OCT system were moved to a different test chamber with a low-power probe beam picked off from the BELLA laser frontend. The experimental layout is shown in FIG. 16. Pulses with 7 nJ/pulse and 800 nm central wavelength were stretched to a pulse duration on the order of 100 ps and then amplified in a regenerative amplifier up to 1 mJ/pulse. At this point, a fraction (~37 nJ) of the energy was focused into a 25 m single-mode fiber by a 10× microscope objective. The fiber transported the pulses to an adjacent room with a low-power test bench.

Figure 17:
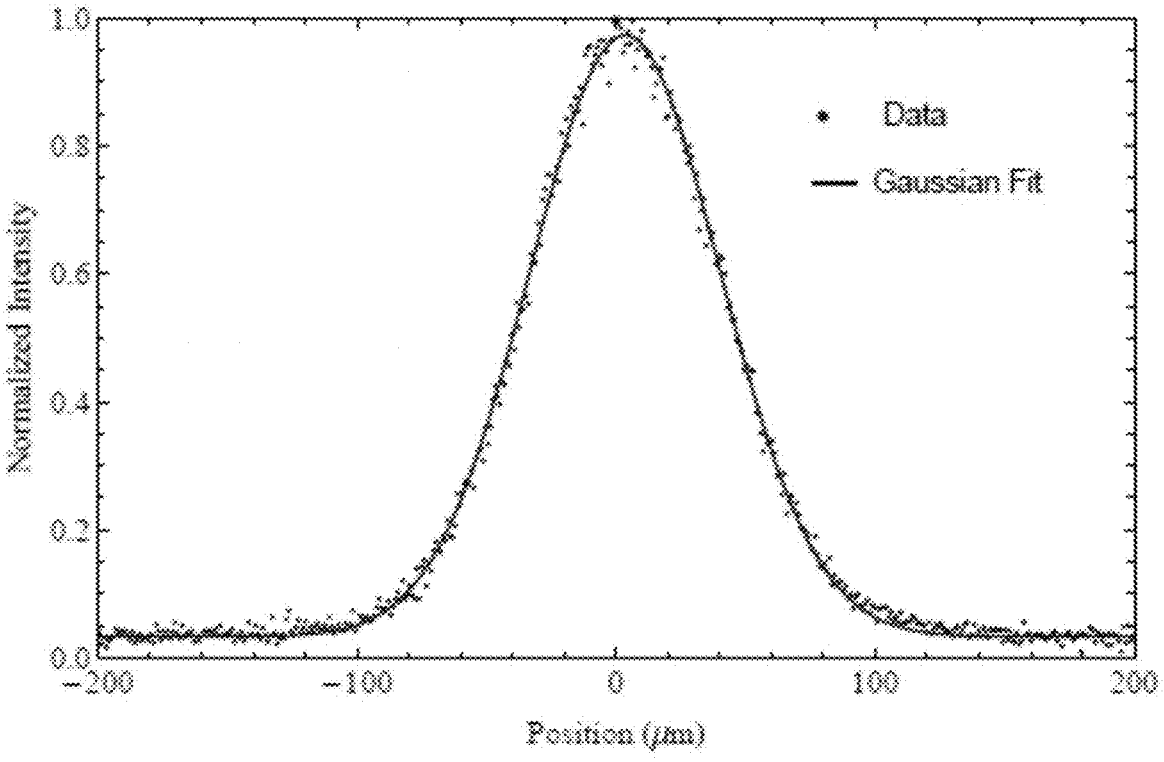
FIG. 17 shows an example of the horizontal lineout across the center of the beam at focus and Gaussian fit.

At the end of the fiber, the pulse was split into two beam paths, each with 50% of the total energy. Only one of the beam paths was used in the following guiding experiments. The beam was then collimated and expanded by a Galilean telescope. A 1.68 m focal length lens focused the beam to an 87 μm FWHM spot size. FIG. 17 shows a horizontal lineout of the focused mode across the beam center and the Gaussian fit from which the beam spot size was derived.

The capillary sat on top of a hexapod for six-axis alignment in angle and position to the laser beam line. The capillary was installed such that the laser was focused at the capillary entrance. The OCT system imaged along the length of the capillary when it was translated 20 mm out of the beam path. Because the laser propagated through the center of the vacuum chamber, 13 inches from the nearest window, a one-to-one imaging relay was installed using two 200 mm focal length, 2 inch diameter achromats. The f-number was kept low to collect as much light as possible. At larger f-numbers, the signal reflected off the deposited ice was too weak to measure.

Figure 18:
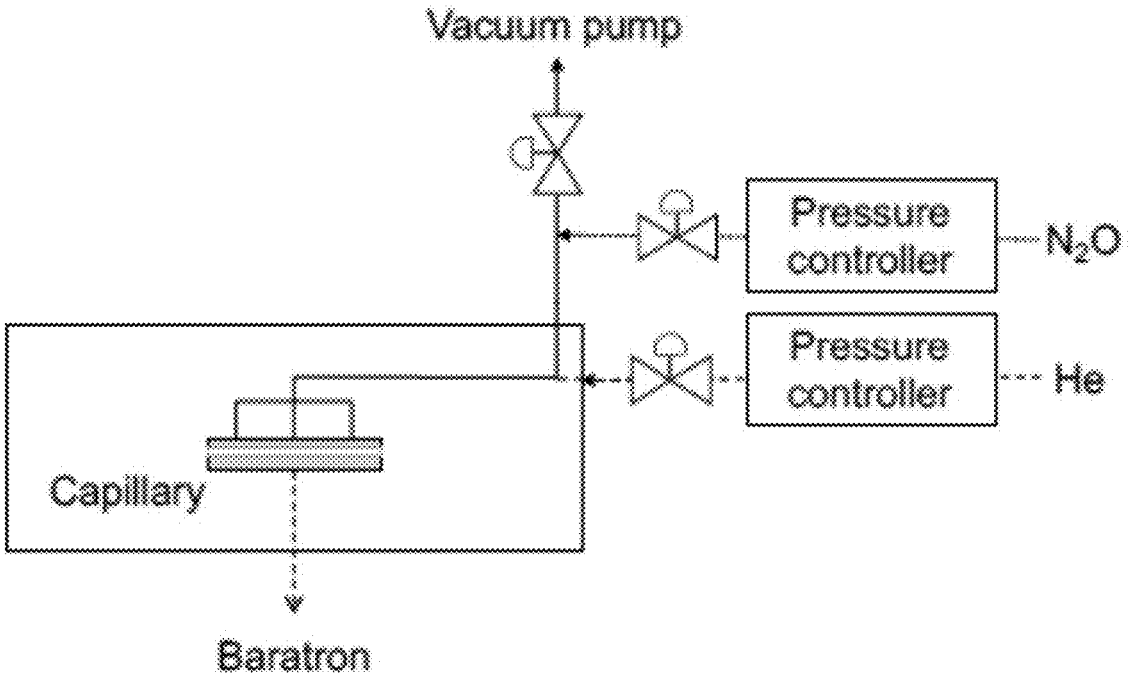
FIG. 18 shows an example of a schematic diagram of a gas distribution system.

After the capillary, a lens roughly collimated the beam before it left the vacuum chamber and propagated to a CCD camera measuring the beam mode. The camera was installed on a stage which allowed its imaging plane to be translated from the capillary entrance to the capillary exit. The liquid nitrogen was supplied by a 160 L dewar, and the temperature of the sapphire was measured by a thermocouple. A 100 psi pressure controller regulated the pressure of the nitrous oxide gas flowing into the capillary while a 500 Torr pressure controller regulated the pressure of the helium gas added to initiate discharge. A valve system was installed for further regulating the gas flow as shown in FIG. 18. Both $N_2O$ and He flowed into the capillary through the outside gas slots. To evacuate the gas lines, a vacuum pump was connected to the gas line, and a baratron measured the pressure inside the capillary.

Guiding Results. The capillary was roughly aligned by imaging the laser output mode. An ice layer of desired thickness was grown and measured to confirm a uniform ice shell. The probe beam was focused into the entrance of the capillary, and the mode camera positioned to image the capillary exit. 20 Torr of helium gas was continuously flowed through the channel, and the pulser voltage was maintained at 17 kV. Both the laser and discharge fired at a 1 Hz repetition rate.

FIGS. 19A and 19B show the measured output FWHM spot size and peak intensity normalized to the input peak intensity as a function of timing between the arrival of the laser pulse and the peak of the discharge (discharge delay). It can be seen that with a larger capillary radius, there was little change in spot size and intensity over the duration of the discharge delays investigated. As the channel radius decreased, a larger change in output parameters was observed.

The matched spot size during the discharge pulse can be calculated from the output spot size and peak intensity. The matched spot size once the density profile has reached steady-state can be calculated assuming a capillary helium pressure of 20 Torr and gas temperature of 300 K. FIGS. 20A and 20B show the matched spot size as a function of timing in the discharge (points) and once the density profile has reached steady state (lines). Each point is the average of many shots occurring within a 50 ns timing window. When the laser arrived before the start of the discharge pulse, the plasma channel had not yet formed. During the rise time of the discharge, the matched spot size decreases as the channel develops until the peak of the discharge where the largest density drop between the channel wall and center is reached. After this point, the matched spot size increases again. These dynamics can be observed in each of the different channels. The reduction in matched spot size is largest in a small diameter capillary.

The different methods for calculating the matched spot sizes result in different values, especially when the spot size is large. In the channel with a 0.7 mm diameter, the minimum matched spot size as calculated using the output spot size and the normalized peak intensity differ by 12%. However, as the output spot size increases, as in the case of the 1 mm channel, the calculated matched spot sizes differ significantly. This deviation from the theoretical guiding can be attributed to two effects: a non-Gaussian mode and interactions with the capillary wall. When the beam propagates without the channel, the spot size does not evolve according to theory, indicating that the beam contains higher order modes. These modes interfere and result in a more complicated relationship between the measured output parameters and the matched spot size. In addition, the matched spot size derivation assumes a parabolic density profile, which is no longer valid for larger spot sizes. As the spot size increases, the beam can sample the non-parabolic density regions of the channel at larger radii and interact with the walls. These effects contribute to the difference between the calculated matched spot sizes using the output spot size and intensity. Other techniques using the transverse oscillations undergone by the laser when the laser is intentionally offset from the channel axis can also determine the matched spot size and are less sensitive to the higher order mode content of the beam. Work on improving the accuracy of the calculated matched spot size in the cryogenically formed waveguide will be done in the future.

Example 4—Applications for Laser Plasma Acceleration

Improving Repetition Rate. With a 50 nm/shot ablation rate, the ice shell survived 200 shots before the thickness decreased by 12 μm. Hundreds of shots could be fired before the ice layer had to be regrown. This process consisted of melting the ice layer by flowing room temperature nitrogen or air through the liquid nitrogen lines to warm up the capillary, and then regrowing a new ice layer. In total, regrowing another ice channel could take several minutes if the capillary temperature was close to the freezing temperature or 20 minutes if the temperature had leveled off around 120 K.

However, theory and preliminary data suggests that the ice layers can be redeposited on top of already frozen ice shells. Instead of thawing the depleted ice shell and regrowing an entirely new one, $N_2O$ can be deposited between shots to recoup the thickness ablated by the discharge and laser. To deposit a layer on top of an existing ice shell requires either better control over the capillary temperature or a high flow rate. Instead of allowing the capillary temperature to decrease over time, as was done in the experiments, finer temperature control could maintain the wall temperature near the freezing temperature. When $T_w \sim T_f$, ice freezes more uniformly, and depositing ice on top of existing ice shells becomes possible. Similarly, a large flow rate leads to slower growth and thus a more uniform ice deposition even when the wall temperature is low. Experiments have demonstrated this technique of freezing successive ice layers. Three layers were frozen when the temperature of the capillary was around 125 K, but the ice froze uniformly as a result of the high flow rate.

If the gas slots are also cold, $N_2O$ will deposit inside the slots and over time can cause a blockage. This problem can be mitigated by either actively warming the slots or, at the very least, separating the gas slots from the main body of the capillary. If these problems are addressed, redeposition may be possible. For short gas valve opening times, the ice grows at a rate of 82 μm/s. For an ablation rate of approximately 50 nm/shot, it takes 0.6 ms to regrow the amount ablated. In addition, during the discharge shot, the temperature of the helium rapidly increases and the plasma expands, flowing into the vacuum chamber and up the gas slots. After the discharge, the helium inside the channel has to be replenished. Simulations of the gas flow after the discharge pulse show that a 33 mm long, 0.5 mm diameter capillary can be refilled with less than 0.2% pressure variation between the capillary center and the gas slots within 0.6 ms. With enough cooling capacity and a wall temperature a few degrees below the freezing temperature, freezing of nitrous oxide and refilling of helium can occur simultaneously without the helium heating the capillary walls and causing the ice to melt. With a gas handling system that operates fast enough, ice layers can be regrown between each laser shot, and the capillary can operate at a kHz repetition rate. The requirements on the gas system are less stringent with a 1 Hz repetition rate. As the ice shell will last hundreds of shots before the matched spot size changes by a few percent, the ice layer does not have to be replenished every shot. Therefore, by depositing nitrous oxide on top of existing ice shells, the repetition rate of the cryogenically-formed waveguide can be improved over what was demonstrated in these experiments.

Here, waveguide diameters ranging from 950 μm to 600 μm were demonstrated, but the technique for ice deposition can be extended to much smaller diameters. These thicknesses were limited by the ice deposition inside the gas slots, eventually plugging them shut, a problem that can be mitigated by locally heating the gas slots. Smaller diameter ice shells can also be achieved by starting with a smaller diameter capillary. The model used depends on the ratio of the solid-gas interface diameter and the capillary diameter. As long as the gas flow conditions still apply, the same ratio achieved in these experiments can be achieved in a smaller diameter capillary, leading to smaller diameter channels.

While only low power guiding was demonstrated here, future work will consist of studying the cryogenically formed waveguide's ability to guide a high-power laser and sustain a wake inside the channel. At higher laser energies, two effects can contribute to a reduced channel lifetime: direct laser ablation and residual energy in the driven wake. As the parabolic plasma channel develops, the density profile rapidly increases as it approaches the ice shell wall. If the laser is well guided inside the channel, the density steepness at the wall protects the ice from direct laser ablation. In addition, if the laser drives a wake inside the channel, the wake energy will be transferred to the ice shell, adding heat which can cause the ice to melt. This heat load can be mitigated by extracting the energy with a second, lower-intensity laser pulse propagating behind the first. The second pulse excites a wake inside the channel which destructively interferes with the first and absorbs the excess energy in the wake. However, due to the complexity of this process, the survival of the ice shell with a high-power laser and excited plasma wake will have to be investigated.

Additional Guiding Techniques. Due to the regenerative nature and ability to grow varying thickness ice layers, the applications of the cryogenically formed waveguide can be extended beyond what has been demonstrated here. Unlike in a pre-formed plasma channel generated by a discharge pulse where the laser guiding and particle acceleration properties are both dependent on the plasma density, grazing incidence guiding decouples the two. In this technique, the guiding properties are determined by the waveguide radius. However, to guide by grazing incidence, the radius of the capillary cannot be significantly greater than the spot size of the laser $w_0$. To guide the fundamental mode with maximum transmission, the capillary radius r must satisfy $w_0$=0.645r. At these small radii, interaction of the wings with the capillary wall and entrance can create damage. Thus, solid waveguides often have limited lifetimes.

In a cryogenically formed waveguide, the ice shell thickness can be restored by depositing more ice at the interface. Either the ice layer can be continuously rebuilt as it becomes ablated or the entire depleted ice layer can be melted and a new shell frozen. The regenerative nature of this design enables a longer lifetime waveguide for applications including grazing incidence guiding.

In addition, the radius of the waveguide can be adjusted without machining a whole new capillary by modifying the time over which the ice is deposited. The inner diameter of the ice shell can be made very small, providing flexibility for different experiments. For example, in matched guiding in a pre-formed plasma channel, the matched spot size is dependent on the channel radius and the density drop. The plasma density is often fixed within a certain range to accelerate particles to a desired final energy. Therefore, the ability to tune the channel radius can enable better matching of the guiding channel to the driving laser.

By decoupling the laser guiding properties and particle acceleration, the cryogenically formed waveguide can be suitable as a near-hollow plasma channel. The density inside the channel is independently controlled from the wall density and can be adjusted to any desired value. Ionization of the wall by either a discharge pulse or a second laser can form a near-hollow plasma channel which potentially can guide a laser pulse and accelerate particles. Unlike previous hollow plasma channel designs, the cryogenically formed waveguide allows for independent control over the wall and channel densities, and a hollow plasma channel can be achieved.

CONCLUSION

Methods and apparatus described herein will enable a reliable plasma structure for laser plasma accelerators that can provide electron beams from the MeV level to the multi-GeV level. For example, the apparatus could be used in compact electron accelerators that will have applications in medical devices for cancer treatment, in high-energy particle colliders for particle physics, and advanced light sources such as x-ray or gamma-ray sources that could be located at universities, industrial facilities, or deployed in the field. Further details regarding the embodiments discussed herein can be found in K. Swanson, "Injection and Plasma Waveguides for Multi-Stage Laser Plasma Acceleration", a dissertation submitted in partial satisfaction of the requirements for the degree of Doctor of Philosophy in Physics in the Graduate Division of the University of California, Berkeley, Spring 2019.

In the foregoing specification, the invention has been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

What is claimed is:

1. A device comprising:

a block of material, the block of material defining a channel having a cylindrical shape and having a first open end and a second open end, an axis of the channel lying along a straight line, and the block of material further defining a first gas port and a second gas port, the first gas port and the second gas port being in fluid communication with the channel, the first gas port and the second gas port operable to allow for a flow of a gas into the channel when the device is in operation; and a cooling system operable to cool the channel to below the freezing point of the gas.

2. The device of claim 1, wherein the channel has a length of about 1 centimeter to 50 centimeters, and wherein the channel has a diameter of about 100 microns to 5 millimeters.

3. The device of claim 1, wherein the cooling system comprises a first metal block and a second metal block, wherein the first metal block is in contact with a first side of the block of material, wherein the second metal block in contact with a second side of the block of material opposite the first side, and wherein the first metal block and the second metal block lie along the axis of the channel.

4. The device of claim 3, wherein the first metal block defines a first liquid channel, wherein the second metal block defines a second liquid channel, wherein the first liquid channel is operable to allow liquid nitrogen to flow through the first metal block, and wherein the second liquid channel is operable to allow liquid nitrogen to flow through the second metal block.

5. The device of claim 3, further comprising:

a first heater in contact with the first metal block; and a second heater in contact with the second metal block.

6. The device of claim 1, further comprising a first electrode defining a first electrode aperture, wherein the first electrode is proximate the first open end of the channel; and a second electrode defining a second electrode aperture, wherein the second electrode is proximate the second open end of the channel.

7. The device of claim 6, further comprising:

a first insulator disposed between the block of material and the first electrode, wherein the first insulator defines a first insulator aperture; and a second insulator disposed between the block of material and the second electrode, wherein the second insulator defines a second insulator aperture.

8. The device of claim 6, further comprising:

a power source connected to the first electrode and the second electrode.

9. The device of claim 1, further comprising:

a gas system connected to the first gas port and the second gas port, wherein the gas system is operable to inject the gas into the channel.

10. The device of claim 1, wherein the block of material comprises two pieces of material, wherein each piece of material defines half of the channel, and wherein the two pieces of material define the channel when they are joined to one another.

11. A method comprising:

(a) cooling a material defining a channel to below a freezing point of a gas, the channel having a cylindrical shape and having a first open end and a second open end, an axis of the channel lying along a straight line; and (b) introducing the gas to the channel, the gas freezing on the material defining the channel.

12. The method of claim 11, wherein operation (b) is performed by introducing the gas through a first gas port and a second gas port defined in the material defining the channel, and wherein the first gas port and the second gas port are in fluid communication with channel.

13. The method of claim 11, wherein the gas comprises nitrous oxide ($N_2O$) or carbon dioxide ($CO_2$).

14. The method of claim 11, wherein a thickness of the gas frozen on the material defining the channel is uniform about a circumference of the channel.

15. The method of claim 11, wherein a thickness of the gas frozen on the material defining the channel is uniform along the axis of the channel.

16. The method of claim 11, further comprising:

after operation (b), injecting a laser beam into the first open end of the channel such that the laser beam travels through the channel and exits the second open end of the channel.

17. The method of claim 16, wherein the laser beam ionizes the gas frozen on the material defining the channel.

18. The method of claim 11, wherein a first electrode defines a first electrode aperture, wherein the first electrode is proximate the first open end of the channel, wherein a second electrode defines a second electrode aperture, and wherein the second electrode is proximate the second open end of the channel, the method further comprising:

applying a voltage to the first electrode while the second electrode is held at ground to ionize at least some of the gas frozen on the material defining the channel; and injecting a laser beam into the first open end of the channel such that the laser beam travels through the channel and exits the second open end of the channel.

19. The method of claim 11, the method further comprising:

introducing a second gas to the channel; and injecting a laser beam into the first open end of the channel such that the laser beam travels through the channel and exits the second open end of the channel.

20. The method of claim 19, wherein the second gas is selected from a group consisting of hydrogen, helium, nitrogen, argon, a mixture of nitrogen and hydrogen, and a mixture of nitrogen and helium.

* * * * *